US007205955B2

(12) United States Patent
Shirosaka et al.

(10) Patent No.: US 7,205,955 B2
(45) Date of Patent: Apr. 17, 2007

(54) ANTENNA

(75) Inventors: Toshiaki Shirosaka, Kobe (JP); Shingo Fujisawa, Kobe (JP)

(73) Assignee: DX Antenna Company, Limited, Kobe-shi, Hyogo-ken (JP)

( * ) Notice: Subject to any disclaimer, the term of this patent is extended or adjusted under 35 U.S.C. 154(b) by 8 days.

(21) Appl. No.: 11/239,257

(22) Filed: Sep. 30, 2005

(65) Prior Publication Data

US 2006/0139230 A1 Jun. 29, 2006

(30) Foreign Application Priority Data

Dec. 28, 2004 (JP) ..... 2004-379963
Aug. 26, 2005 (JP) ..... 2005-246049

(51) Int. Cl.
*H01Q 1/50* (2006.01)

(52) U.S. Cl. ..... 343/850; 343/824

(58) Field of Classification Search ..... 343/850, 343/853, 824, 833, 834
See application file for complete search history.

(56) References Cited

U.S. PATENT DOCUMENTS

| | | | | |
|---|---|---|---|---|
| 3,721,990 | A | 3/1973 | Gibson et al. | |
| 5,274,391 | A * | 12/1993 | Connolly | 343/820 |
| 6,650,301 | B1 | 11/2003 | Zimmerman | |
| 2002/0050954 | A1 | 5/2002 | Oh et al. | |

FOREIGN PATENT DOCUMENTS

| | | | |
|---|---|---|---|
| EP | 1 098 391 | A2 | 5/2001 |
| JP | 5-63435 | A | 3/1993 |
| JP | 2000-13130 | A | 1/2000 |
| JP | 2001-85928 | A | 3/2001 |
| JP | 2004-187195 | A | 7/2004 |
| JP | 2004-282319 | A | 10/2004 |

OTHER PUBLICATIONS

Deal et al., IEEE Transactions on Microwave Theory and Techniques, vol. 48, No. 6, pp. 910-918, (Jun. 2000).

Karl Rothammel: "Antennenbuch", Franckh-Kosmos Verlags-GMBH & Co., Stuttgart, pp. 70-71, 423, 452-456, (1991), no month.

* cited by examiner

*Primary Examiner*—Hoang V. Nguyen
(74) *Attorney, Agent, or Firm*—Birch, Stewart, Kolasch and Birch, LLP

(57) ABSTRACT

A transmission line includes transmission lines parallel and perpendicular, respectively, to a flat portion of a reflector, and the parallel transmission line and the flat portion form a first strip line and the perpendicular transmission line and a conductive plate similarly form a second strip line. Radiators and the transmission line have a radiation impedance and a characteristic impedance, respectively, both set at 150Ω when the antenna's output terminal has a reference impedance of 75Ω. If the parallel transmission line has a midpoint serving as the output terminal of the antenna this portion's receiving current is divided in two so that an impedance of half that of the strip line can be provided and a coaxial cable can directly be connected to the transmission line. A matcher or a mixer is not included in the antenna, and matching and mixing losses can be prevented.

20 Claims, 19 Drawing Sheets

ANTENNA

This nonprovisional application is based on Japanese Patent Applications Nos. 2004-379963 and 2005-246049 filed with the Japan Patent Office on Dec. 28, 2004 and Aug. 26, 2005, respectively, the entire contents of which are hereby incorporated by reference.

BACKGROUND OF THE INVENTION

1. Field of the Invention

The present invention relates generally to antennas reduced in size and having excellent reception characteristics and in particular to antennas receiving electric waves of ultrahigh frequency (UHF) band.

2. Description of the Background Art

Conventionally a variety of antennas have been proposed for different applications. In recent years, in particular, a variety of miniature antennas, omnidirectional antennas and the like intended to be installed indoors, mounted in mobile terminals and the like are proposed.

For example Japanese Patent Laying-open No. 2000-13130 discloses an antenna having a plurality of closed loop elements to be capable of reducing the size of a closed loop element for accommodating a desired frequency band and also of having large directivity.

Furthermore Japanese Patent Laying-open No. 2004-282319 discloses an antenna having a main body member implemented by a flat plate of metal in a strip having a prescribed width and thickness and a prescribed geometry.

Furthermore Japanese Patent Laying-open No. 2001-85928 discloses a folded dipole antenna having an antenna element of conductor formed in a folded square belt.

Furthermore Japanese Patent Laying-open No. 5-63435 discloses an antenna apparatus having a radiation element with an additional element arranged adjacent thereto to allow an antenna to cause complex resonance to achieve an increased band width. This antenna apparatus has the radiation element and the additional element with a reactance element loaded thereto to change a value in reactance to provide impedance-matching with the characteristic impedance of a feeder. The antenna apparatus can thus achieve sufficient reception over a wide band.

In Japan, digital terrestrial broadcasting started in 2003 and its viewable area is currently increasing. Accordingly, reception equipment with a digital high-definition (DH) reception mark attached thereto has been introduced in the market.

The DH mark is a symbol mark guaranteeing that equipment with the mark is reception system equipment registered with Japan Electronics and Information Technology Industries Association (JEITA) and at least having a specified level of performance. Products subject to registration for the DH mark include ultrahigh frequency (UHF) antennas receiving digital terrestrial broadcasts.

For an antenna receiving a television broadcast signal, Yagi antenna is often used. For Yagi antenna, such improvements are generally introduced as increasing the numbers of guidewaves or the area of the reflector to improve gain, front-to-back ratio, and other performance.

Furthermore, as another approach to enhance an antenna in performance the antenna is changed in configuration to be different than conventional. For example as an antenna capable of improving gain a stacked antenna having a plurality of antennas combined together is conventionally known.

FIG. 25 shows an example of a configuration of a stacked antenna.

With reference to the figure, a stacked antenna 100 includes antennas ANT11 and ANT12 each being a Yagi antenna receiving a UHF band electric wave which is in turn input via matchers 101 and 102 to a mixer 103 mixing the two electric waves together for output.

Antennas ANT11 and ANT12 each have an output impedance of 300Ω. Mixer 103 has an input impedance of 75Ω. If antennas ANT11 and ANT12 are directly connected to mixer 103, a loss associated with mismatching in impedance is increased. To match in impedance, matchers 101 and 102 are connected to antennas ANT11 and ANT12, respectively.

Typically, Yagi antenna is installed outdoors for use. As such, if the antenna is increased in size, it requires a larger area for installation and is also more susceptible to wind. In particular, if a Yagi antenna having a reflector increased in area to achieve enhanced performance receives wind, it is susceptible to damage.

In particular, the tendency to increase antennas in size significantly appears for wide band antennas capable of receiving analog and digital terrestrial broadcasts. If a single Yagi antenna is used with an increased gain to receive an electric wave of a UHF low channel band (13–44 channels) such as digital terrestrial broadcasting, the antenna is necessitated to be larger. Larger antennas, however, tend to cause problems associated with installation area, damage, and the like as described above.

Furthermore, for the stacked antenna shown in FIG. 25, the matchers and the mixers provide losses, and the performance is not improved as theoretically expected.

Furthermore, the above described miniature and omnidirectional antennas do not have performance suitable for receiving digital terrestrial broadcasts. First, conventional antennas reduced in size are reduced in gain and other performance. Furthermore, omnidirectional antennas receive not only an electric wave from a transmitting antenna but also that reflected from any obstacle existing therearound. Thus omnidirectional antennas are susceptible to multipath propagation.

For analog broadcasting, multipath propagation causes a ghost on a television screen. For digital broadcasting, if multipath propagation exceeding a level is caused no image will not be shown on a television screen. As such, conventional miniature and omnidirectional antennas are unsuitable for receiving digital terrestrial broadcasts.

SUMMARY OF THE INVENTION

The present invention contemplates an antenna miniaturized and having reception characteristics superior to conventional antennas.

The present invention in summary provides an antenna including: a reflector formed of conductor and having a flat portion reflecting a prescribed electric wave; a first transmission line facing the flat portion with a prescribed distance therebetween; and a plurality of radiators each formed of conductor and arranged on a same side as the first transmission line relative to the flat portion, and the plurality of directors each have first and second feed points arranged to have a distance from the flat portion larger than the prescribed distance. The present antenna further includes: a plurality of second transmission lines associated with the plurality of radiators, respectively, and electrically connecting the first feed point and the first transmission line together; and a plurality of conductive plates arranged parallel to the plurality of second transmission lines, respectively, and electrically connecting the second feed point and the flat portion together, and the plurality of conductive plates, as seen along the second transmission line, have a surface facing the second transmission line and larger in width than the second transmission line.

Preferably each of the second transmission lines and each of the plurality of conductive plates are arranged perpendicular to the flat portion.

More preferably the plurality of conductive plates are each arranged outer than the second transmission line with respect to an axis passing a midpoint of the first transmission line and perpendicular to the flat portion and if the second feed point is located more adjacent to the axis than the first feed point, the plurality of conductive plates are each electrically connected to the second feed point such that that portion of the conductive plate connected to a corresponding one of the radiators traverses the second transmission line.

Preferably the antenna further includes a plurality of directors associated with the plurality of radiators, respectively, and formed of conductor.

More preferably each of the plurality of directors and the flat portion sandwich a corresponding one of the radiators and each of the plurality of directors includes a plurality of parallel conductive plates.

More preferably the plurality of radiators each include first and second radiation planes symmetrical with respect to an axis including a line segment connecting the first and second feed points, and the plurality of directors are each provided for each the first and second radiation planes to face each of the first and second radiation planes.

More preferably the plurality of directors each include a center and an end adjacent to the center and at least having a portion having a distance from the flat portion different from that between the center and the flat portion.

Preferably the plurality of radiators are two radiators both having an input impedance of a prescribed value multiplied by two. The plurality of second transmission lines are two conductive lines both having a characteristic impedance of the prescribed value multiplied by two. The first transmission line has a characteristic impedance of the prescribed value multiplied by two, and has opposite ends connected to the two conductive lines, respectively, and a midpoint provided with an output terminal of the antenna.

More preferably the two radiators each include first and second dipole elements having third and fourth feed points. The first and second dipole elements are provided such that the third feed points overlap and the fourth feed points overlap or such that the third feed points are adjacent to each other and the fourth feed points are adjacent to each other. The first feed point is one of: the third feed points overlapping; and a point on a line segment connecting adjacent ones of the third feed points together. The second feed point is one of: the fourth feed points overlapping; and a point on a line segment connecting adjacent ones of the fourth feed points together.

Further preferably the first and second dipole elements are each formed to at least have a portion increasing in dimension, as seen in a direction perpendicular to the axis, at locations further away from a midpoint of a line segment connecting the third and fourth feed points and along an axis passing through the third and fourth feed points.

Further preferably the reflector further has a peripheral portion surrounding the flat portion that is in contact with a side located lower than the first transmission line with the antenna installed and forms a prescribed angle other than 180° relative to the flat portion. The antenna further includes a connector electrically connecting to the midpoint of the first transmission line a cable transmitting an output. The connector is arranged at the peripheral portion at an intersection with an axis passing through the midpoint and perpendicular to the first transmission line.

Preferably the plurality of radiators each include first and second dipole elements and the first and second dipole elements each have third and fourth feed points and at least have a portion increasing in dimension, as seen in a direction perpendicular to the axis, at locations further away from a midpoint of a line segment connecting the third and fourth feed points and along an axis passing through the third and fourth feed points.

Preferably the plurality of radiators are four radiators each having an input impedance of a prescribed value multiplied by two. The plurality of second transmission lines are four conductive lines each having a characteristic impedance of the prescribed value multiplied by two. The antenna further includes a first matcher matching first and second ones of the four conductive lines and the first transmission line in impedance, and a second matcher matching third and fourth ones of the four conductive lines and the first transmission line in impedance. The first transmission line has a characteristic impedance of the prescribed value multiplied by two and also have a midpoint provided with an output terminal of the antenna, and the first transmission line has one and the other ends connected to the first and second matchers, respectively.

More preferably the four radiators each include first and second dipole elements having third and fourth feed points. The first and second dipole elements are provided such that the third feed points overlap and the fourth feed points overlap or such that the third feed points are adjacent to each other and the fourth feed points are adjacent to each other. The first feed point is one of: the third feed points overlapping; and a point on a line segment connecting adjacent ones of the third feed points together. The second feed point is one of: the fourth feed points overlapping; and a point on a line segment connecting adjacent ones of the fourth feed points together.

Preferably the reflector at a portion thereof surrounding the flat portion at least has a portion having a peripheral portion in contact with the flat portion, the peripheral portion forming a prescribed angle other than 180° relative to the flat portion.

Preferably the plurality of radiators each include a center and an end at least having a portion having a distance from the flat portion different from that between the center and the flat portion.

Preferably the first transmission line and the flat portion form a first strip line with the flat portion serving a grounding plate. The plurality of second transmission lines and ones of the plurality of conductive plates corresponding to the plurality of second transmission lines, respectively, form a plurality of second strip lines with the ones of the plurality of conductive plates serving as a grounding plate.

Preferably the antenna further includes a mixer mixing together the prescribed electric wave received and an electric wave of a frequency band different from the prescribed electric wave.

Preferably the antenna further includes an amplifier amplifying the prescribed electric wave received.

Preferably the prescribed electric wave is an electric wave of an ultrahigh frequency band.

The present invention is mainly advantageous in that it can dispense with a matcher and a mixer and as a result no matching and mixing losses can be caused. The present antenna can thus be reduced in size and also enhanced in performance.

The present invention is also advantageous in that it can provide a radiator fed through a strip line and the strip line at a transmission line can have an impedance set to be equal to the characteristic impedance of a coaxial cable. Thus the coaxial cable can directly be connected to the strip line.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
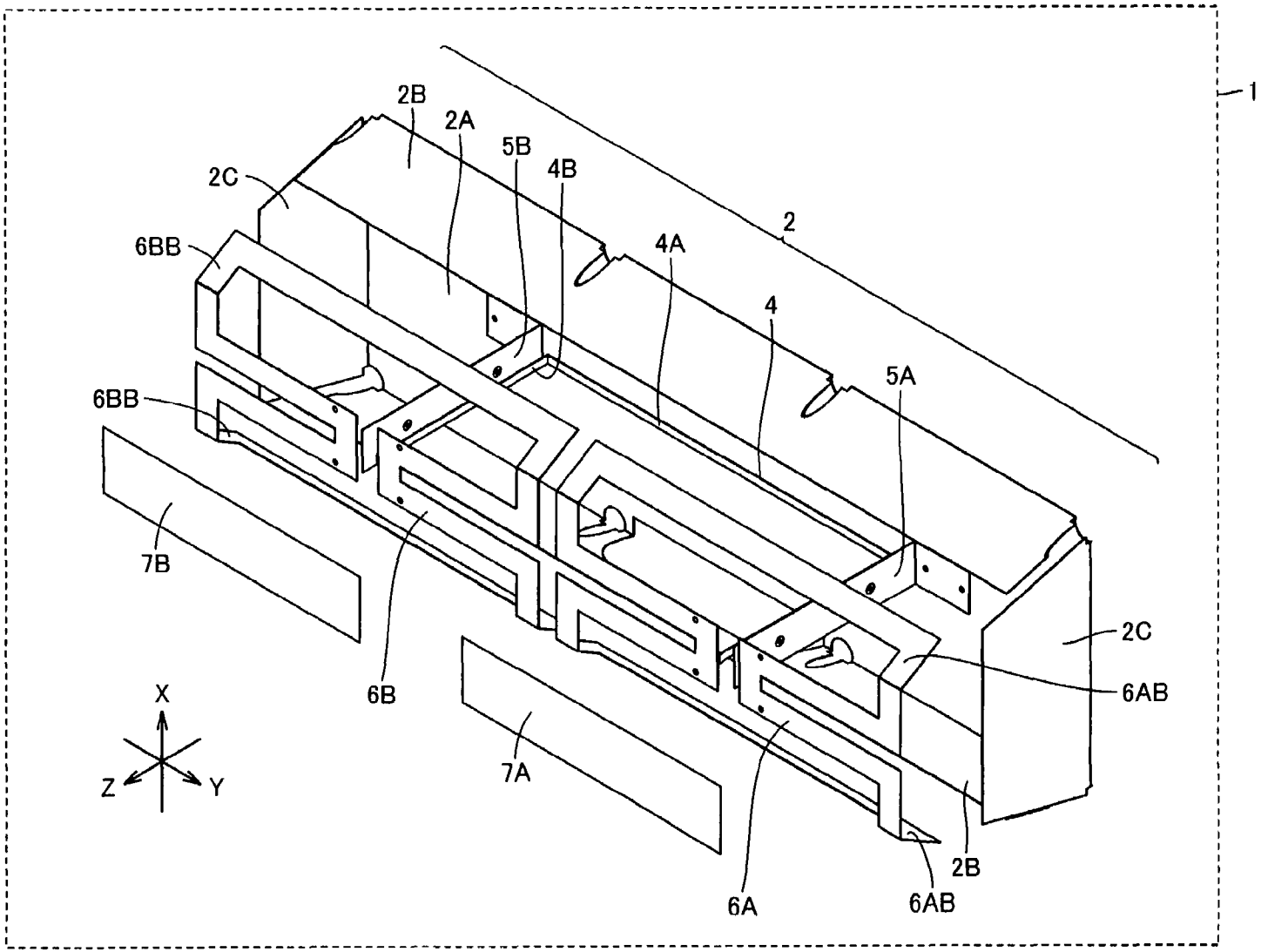
FIG. 1 is an overall view of an antenna in a first embodiment.

Hereinafter the present invention in embodiments will be described with reference to the drawings more specifically. In the figures, identical reference characters indicate identical or like components.

First Embodiment

FIG. 1 is an overall view of the present antenna in a first embodiment.

With reference to the figure, an antenna 1 includes a reflector 2, a transmission line 4, conductive plates 5A and 5B, radiators 6A and 6B, and directors 7A and 7B.

Reflector 2 includes a flat portion 2A reflecting a UHF band electric wave. Reflector 2 is formed of conductor. Note that reflector 2 includes peripheral portions 2B and 2C surrounding flat portion 2A and each forming a prescribed angle other than 180° relative to flat portion 2A. In other words, reflector 2 is provided to have a periphery bent in a direction of reflection (i.e., in the positive direction along the Z axis). Reflector 2 thus structured allows antenna 1 to be reduced in size.

Note that while FIG. 1 shows reflector 2 formed to have peripheral portions 2B and 2C both bent in the direction of reflection, reflector 2 may alternatively be formed to have one of peripheral portions 2B and 2C bent in the direction of reflection.

Transmission line 4 includes a transmission line 4A opposite flat portion 2A with a prescribed distance therebetween, and two transmission lines 4B associated with radiators 6A and 6B, respectively, and electrically connecting and a first one of two feed points that radiators 6A and 6B each have and transmission line 4A. Note that transmission line 4A is parallel to flat portion 2A and transmission line 4B is perpendicular to flat portion 2A.

Conductive plates 5A and 5B are associated with radiators 6A and 6B, respectively, and both electrically connect the second feed points of the radiators and reflector 2. Note that conductive plates 5A and 5B as seen along transmission line 4B (i.e., the Z axis) are each provided such that a surface thereof opposite transmission line 4B is larger in width than transmission line 4B.

Transmission line 4B and conductive plates 5A and 5B are provided perpendicular to flat portion 2A. Transmission line 4B and conductive plates 5A and 5B forming an angle closer to 90° relative to flat portion 2A less affect characteristics of antenna 1.

Radiators 6A and 6B are arranged on the same side as transmission line 4A with respect to flat portion 2A. Each radiator has two feed points. The two feed points and flat portion 2A have a larger distance therebetween than transmission line 4A and flat portion 2A have therebetween. Note that radiators 6A and 6B may both be arranged parallel to flat portion 2A or may be arranged to have a center and an end having different distances, respectively, from flat portion 2A. In other words, to achieve miniaturization, radiators 6A and 6B may have an end bent in the direction of reflection or a direction opposite to that of reflection. In FIG. 1 radiators 6A and 6B include ends 6AB and 6BB, respectively, bent in the direction opposite to that of reflection.

Directors 7A and 7B are associated with radiators 6A and 6B, respectively. The director has a width, a length and the like determined by the electric wave received, as appropriate. Note that if the director is a single conductive plate, characteristics as prescribed cannot be obtained. Accordingly the director is provided for each radiator.

If antenna 1 is for example a UHF television receiving antenna, it has a size as described hereinafter. Note that in the following description antenna 1 has dimensions referred to as "height," "width" and "length" along the X, Y and Z axes, respectively. Antenna 1 has a height of approximately 140 mm, a width of approximately 400 mm and a length of approximately 150 mm.

An 8-element Yagi antenna has a height, a width and a length, as indicated as one example, of 73 mm, 336 mm and 630 mm, respectively. Antenna 1 has a reflector larger in area (as determined by height by width) and smaller in length than that of the 8-element Yagi antenna. As such, the former antenna has a smaller overall size than the latter antenna. Reflector 2 has a larger area in order to provide a front-to-back ratio, a half-width and other characteristics over entire frequency range satisfactorily.

Antenna 1 has a feature, as summarized, as described hereinafter. Of transmission line 4, transmission line 4A parallel to flat portion 2A, and flat portion 2A of reflector 2 form a first strip line. Furthermore, of transmission line 4, transmission line 4B perpendicular to flat portion 2A, and conductive plates 5A and 5B similarly form a second strip line. Radiators 6A and 6B and transmission line 4 have a radiation impedance and a characteristic impedance, respectively, both set at 150Ω when the output terminal of the antenna has a reference impedance of 75Ω. If transmission line 4A has a midpoint serving as the output terminal of the antenna, this potion's receiving current is divided in two. An impedance of half that of the strip line is achieved, and a coaxial cable can directly be connected to transmission line 4. This allows antenna 1 to dispense with a matcher or a mixer causing reduced gain in conventional antennas, and thus free of matching and mixing losses. The antenna can thus be reduced in size and also provide excellent reception characteristics.

More specifically, transmission line 4A is a conductor line in the first strip line and flat portion 2A is a grounding plate. Similarly, transmission line 4B is a conductor line in the second strip line and conductive plates 5A and 5B are grounding plates. Transmission line 4 has a distance from the grounding plate, a width, and the like determined as appropriate to provide an impedance of 150Ω.

Conductive plates 5A and 5B are arranged outer than transmission line 4 substantially in parallel at prescribed, designated interval. More specifically, when the Z axis is set as an axis passing through the midpoint of transmission line 4A and perpendicular to flat portion 2A, conductive plates 5A and 5B are farther from the Z axis than transmission lines 4A and 4B are. By thus providing conductive plates 5A and 5B, transmission line 4 serves as a strip line.

Figure 2:
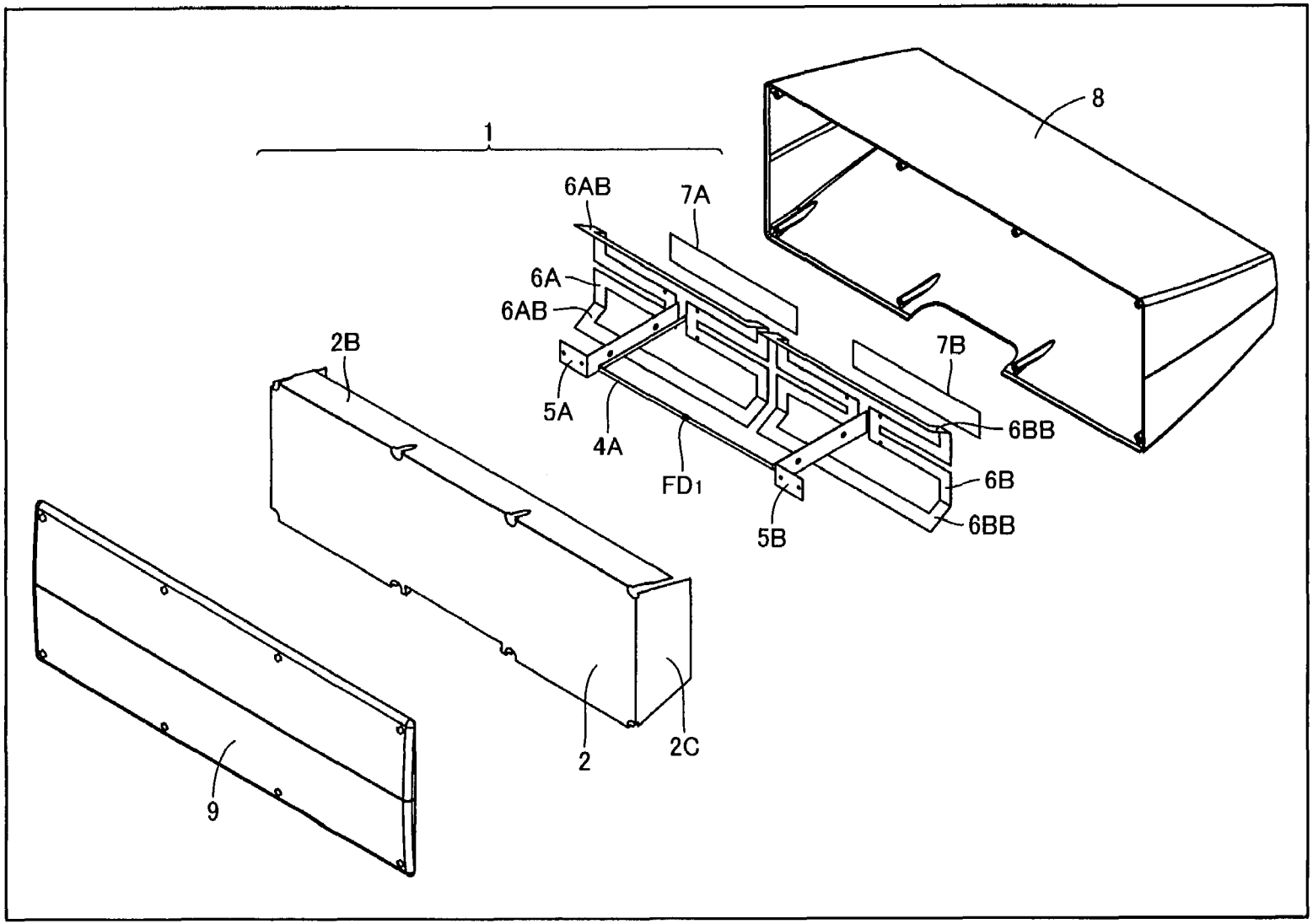
FIG. 2 is an exploded view of an antenna 1 of FIG. 1.

FIG. 2 shows an exploded view of antenna 1 of FIG. 1.

With reference to the figure, antenna 1 is shown exploded into reflector 2, directors 7A and 7B, and a portion excluding and reference 2 and directors 7A and 7B. Note that in an environment in which it is actually used, antenna 1 is provided with covers 8 and 9 formed for example of resin. Antenna 1 is susceptible to wind and rain as it is installed outdoors (e.g., at a veranda). Accordingly, antenna 1 is provided with covers 8 and 9. Note that as shown in FIG. 2, transmission line 4A has a midpoint provided with an output terminal FD1 of the antenna.

Figure 3A:
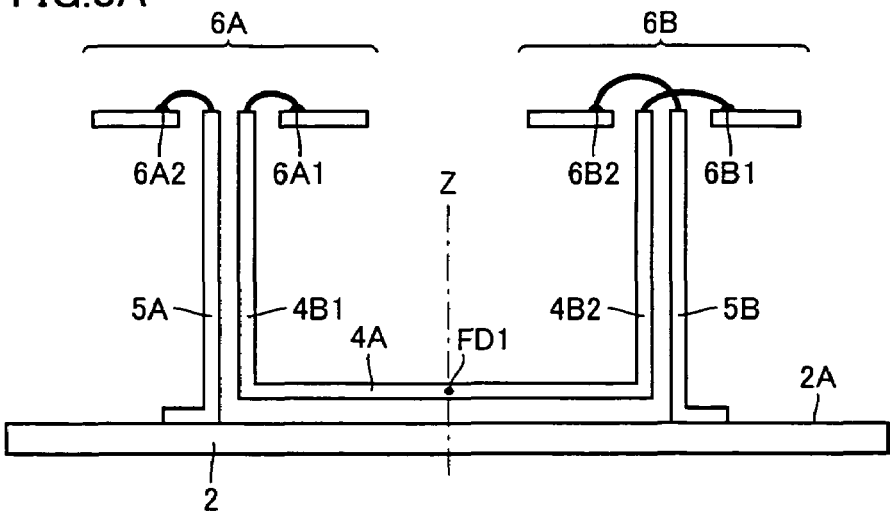
FIG. 3A illustrates how a radiator and a transmission line 4 are connected and how the radiator and conductive plates 5A and 5B are connected.

FIG. 3A illustrates the radiator-transmission line 4 connection and the radiator-conductive plates 5A and 5B connection.

With reference to the figure, transmission line 4A is arranged to be parallel to flat portion 2A with a prescribed distance therebetween. Furthermore transmission line 4B1 and 4B2 are arranged to be perpendicular to flat portion 2A. Conductive plates 5A and 5B are arranged to be perpendicular to flat portion 2A and outer than transmission line 4B1 and 4B2, respectively, in parallel.

Radiator 6A has feed points 6A1 and 6A2. Transmission line 4B1 is electrically connected to feed point 6A1. Conductive plate 5A is electrically connected to feed point 6A2. Similarly, radiator 6B has feed points 6B1 and 6B2. It should be noted, however, that an electric wave received at radiator 6A and that received at radiator 6B need to be composited at the output terminal of the antenna in phase. Accordingly, transmission line 4B2 and conductive plate 5B are connected to feed points 6B1 and 6B2, respectively, such that they traverse each other.

Thus the radiator has a first feed point (6A1 and 6B1) with a transmission line connected thereto and a second feed point (6A2 and 6B2) with a conductive plate connected thereto.

If transmission line 4B2 is connected to feed point 6B2 and conductive plate 5B is connected to feed point 6B1, an electric wave transmitted to transmission line 4B1 and that transmitted to transmission line 4B2 have a phase difference of 180°, and a prescribed output cannot be extracted at the output terminal FD1 of the antenna. Accordingly, transmission line 4B2 and conductive plate 5B are each connected to a feed point such that they traverse each other. Note that providing conductive plate 5B outer than transmission line 4B2, as described above, can prevent unnecessary radiation generated from transmission line 4B2. Accordingly, it is preferable that transmission line 4B2 and conductive plate 5B traverse each other at a position closer to radiator 6B.

Figure 3B:
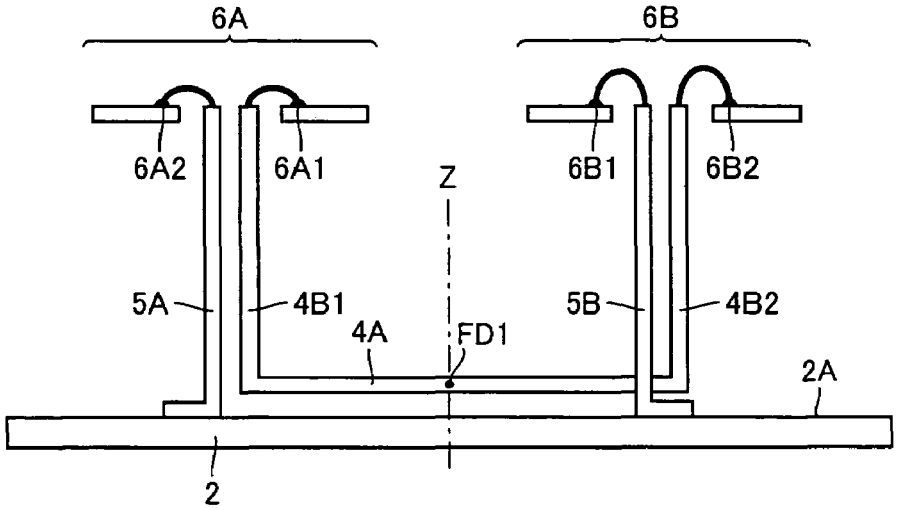
FIGS. 3B and 3C show the connection shown in FIG. 3A in one and another exemplary variations, respectively.

FIG. 3B shows an exemplary variation of the manner of connection shown in the FIG. 3A. The manner of connection of FIG. 3B differs from that of connection of FIG. 3A in that feed points 6B1 and 6B2 of radiator 6B, and transmission line 4B2 and conductive plate 5B are connected without a portion traversing each other. More specifically, FIG. 3B differs from FIG. 3A in that transmission line 4B2 is connected to feed point 6B2 and conductive plate 5B is connected to feed point 6B1 and that conductive plate 5B is provided to be inner than transmission line 4B2. The remainder of FIG. 3B is similar to that of FIG. 3A.

Figure 3C:
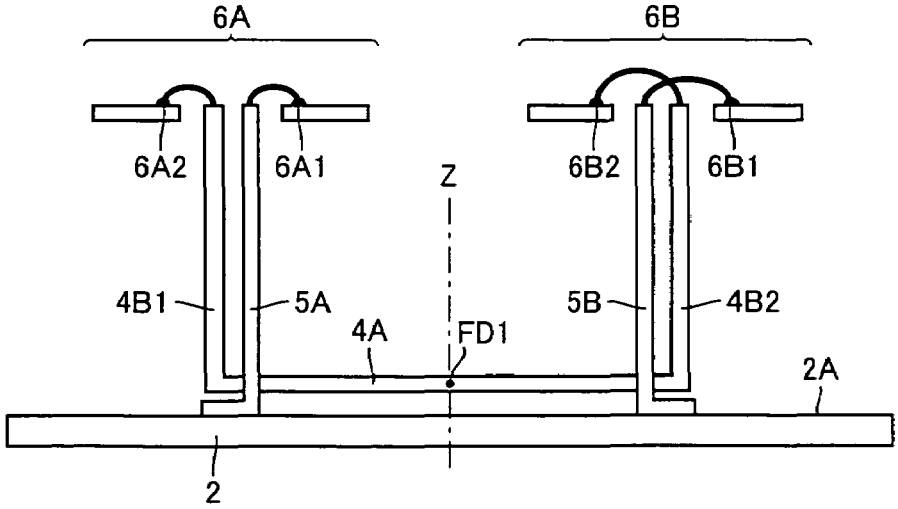

FIG. 3C shows another exemplary variation of the manner of connection shown in FIG. 3A. The manner of connection of FIG. 3C differs from that of connection of FIG. 3A in that transmission line 4B1 is connected to feed point 6A2 and conductive plate 5A is connected to feed point 6A1 and that transmission line 4B2 is connected to feed point 6B2 and conductive plate 5B is connected to feed point 6B1. In other words, conductive plate 5A is provided to be inner than transmission line 4B1 and conductive plate 5B is provided to be inner than transmission line 4B2. The remainder of FIG. 3C is similar to that of FIG. 3A.

Figure 4:
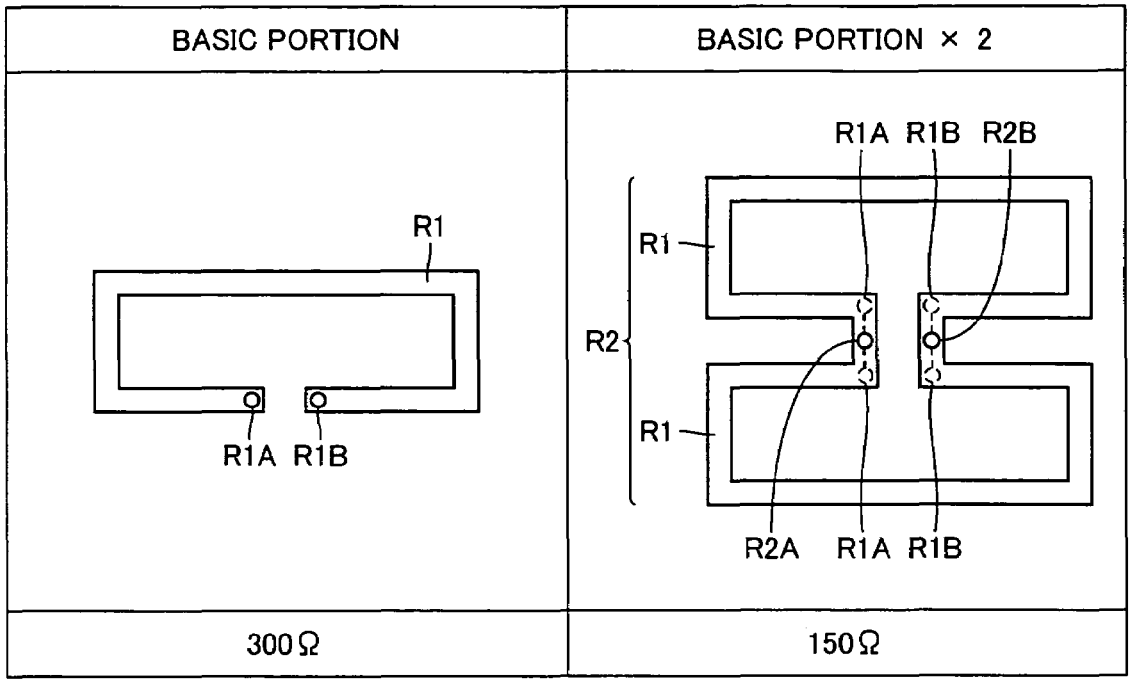
FIG. 4 illustrates a geometry of the radiator and an input impedance of each radiator.

FIG. 4 illustrates a geometry of the radiator and an input impedance at each radiator.

With reference to the figure, two types of radiators' geometries and each radiator's input impedance at are shown. A radiator R1 is a basic portion of radiator 6A or 6B of FIG. 1. Radiator R1 can be a loop antenna with feed points R1A and R1B having an input impedance of 300Ω.

A radiator R2 is a radiator in the form of a combination of two radiators R1s. Radiator R2 is identical in performance to each of radiators 6A and 6B. Radiators 6A and 6B will provide an input impedance of 150Ω. Feed points R2A and R2B correspond to feed points of each of radiators 6A and 6B.

Feed point R2A is provided at an intermediate point of a line segment connecting feed points R1As of the two radiators R1s together. Similarly, feed point R2B is provided at an intermediate point of a line segment connecting feed points R1Bs of the two radiators R1s together. In other words, radiator R2 has feed points R1As or R1Bs adjacent to each other and connected in parallel.

Figure 5:
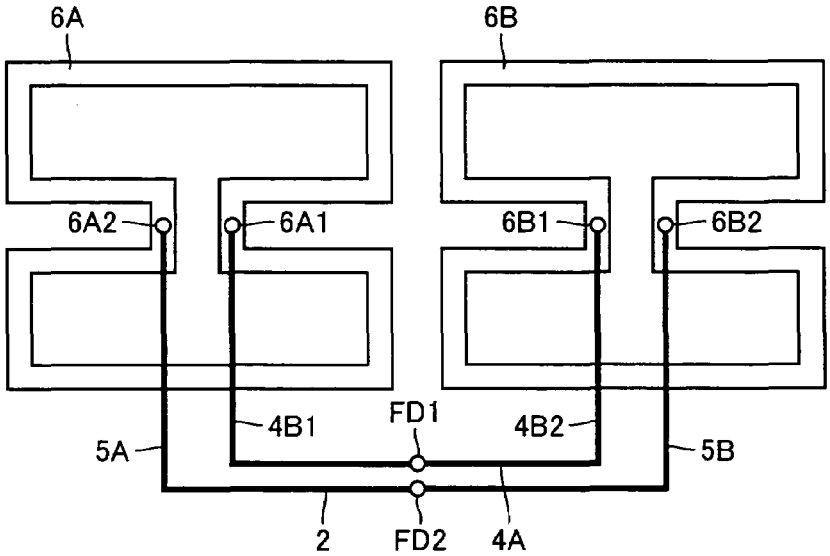
FIG. 5 illustrates an impedance of antenna 1 of FIG. 1 at an output terminal.

FIG. 5 illustrates an impedance of antenna 1 of FIG. 1 at the output terminal.

With reference to the figure, radiators 6A and 6B are each identical in performance to radiator R2 of FIG. 4. Accordingly, radiators 6A and 6B each has an input impedance of 150Ω. To transmission line 4 radiators 6A and 6B are connected in parallel, and the antenna at output terminal FD1 will have an impedance of 150Ω divided by two, i.e., 75Ω.

The antenna at output terminal FD1 has an impedance equal to that of a coaxial cable used for receiving television broadcasts. Furthermore, as radiators 6A and 6B is fed via a strip line, the antenna can have output terminal FD1 with the coaxial cable having an inner conductor connected thereto and an output terminal FD2 (or reflector 2) with the coaxial cable having an outer conductor connected thereto.

Note that if the strip line is not used and instead radiator 6A or 6B has the coaxial cable directly connected thereto, the antenna is excited out of balance since for a coaxial cable its inner and outer conductors pass currents, respectively, unequally (or out of balance). Furthermore between the radiator and the coaxial cable an impedance mismatch is caused, resulting in impaired voltage standing wave ratio (VSWR) and reduced gain.

Conventionally, impedance mismatch is addressed by connecting a matcher between the radiator and the coaxial cable. The first embodiment provides an antenna having output terminals FD1 and FD2 with an impedance of 75Ω. As such, connecting inner and outer conductors of a cable to output terminals FD1 and FD2, respectively, does not cause loss. Thus the antenna will not be impaired in gain.

Figure 6:
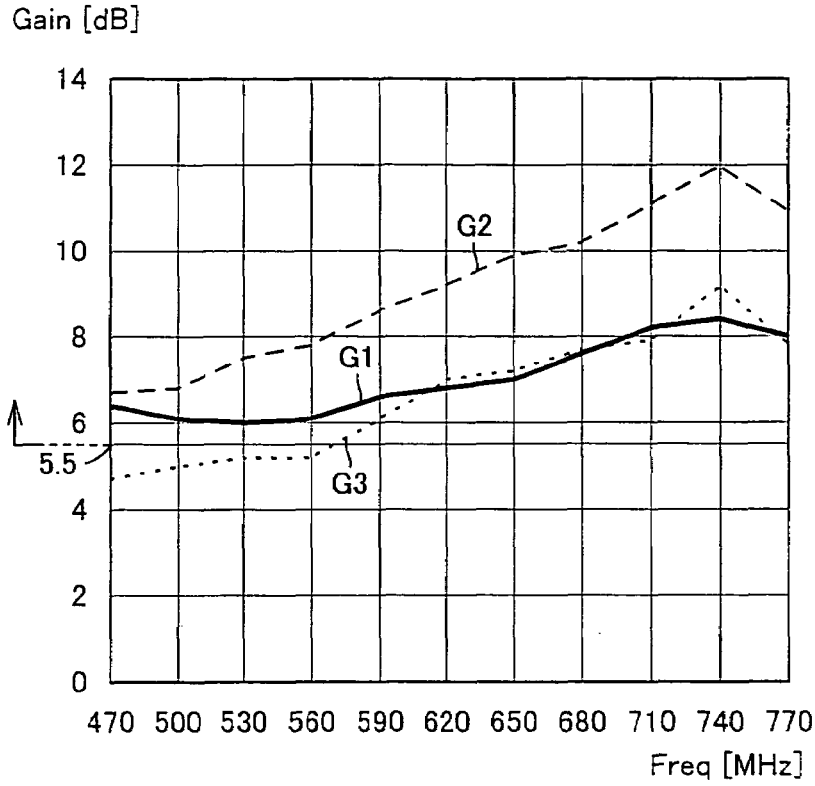
FIG. 6 is a graph representing a gain of antenna 1 of FIG. 1.

FIG. 6 is a graph representing antenna of FIG. 1 in gain.

With reference to the figure, the horizontal axis represents a frequency range and the vertical axis represents gain The frequency range is 470 to 770 MHz. This range is that of an electric wave applied in Japan in UHF television broadcasting. Note that digital terrestrial broadcasting employs a frequency range of 470 to 710 MHz (13 to 52 channels).

In FIG. 6, curves G1–G3 represent how gains vary with frequency. Curve G1 represents how antenna 1 of FIG. 1 varies in gain. For comparison with antenna 1, how 14- and 8-element Yagi antennas vary in gain is indicated by curves G2 and G3, respectively.

When curves G1 and G3 are compared in a range lower than a frequency of 620 MHz, curve G1 is higher than curve G3. More specifically, the present antenna is higher in gain than the 8-element Yagi antenna for a low band. In particular, for antennas used to receive digital terrestrial broadcasts, characteristics for low band are important. The present antenna can thus be said to be more suitable than the 8-element Yagi antenna for receiving digital terrestrial broadcasts.

Figure 7:
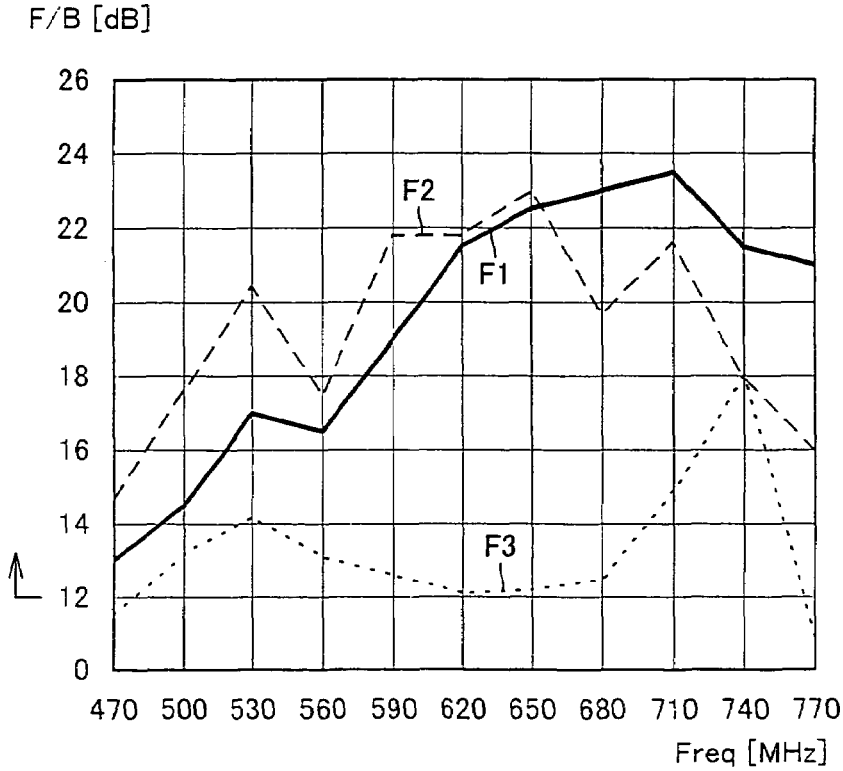
FIG. 7 is a graph representing a front-to-back ratio of antenna 1 of FIG. 1.

FIG. 7 is a graph representing antenna 1 of FIG. 1 in front-to-back ratio.

With reference to the figure, the horizontal axis represents a frequency range and the vertical axis represents front-to-back ratio. The frequency range is the same as that in FIG. 6, i.e., 470 to 770 MHz. Curves F1–F3 represent how antenna 1 of FIG. 1 and 14- and 8- Yagi antennas, respectively, vary in front-to-back ratio.

When curves F1 and F3 are compared, for the entire range of the horizontal axis, curve F1 is larger than curve F3. Furthermore when curves F1 and F2 are compared, for a range lower than a frequency of 650 MHz, curve F2 is higher than curve F1. For a range of 650 to 770 MHz, however, curve F1 is higher than curve F2.

Figure 8:
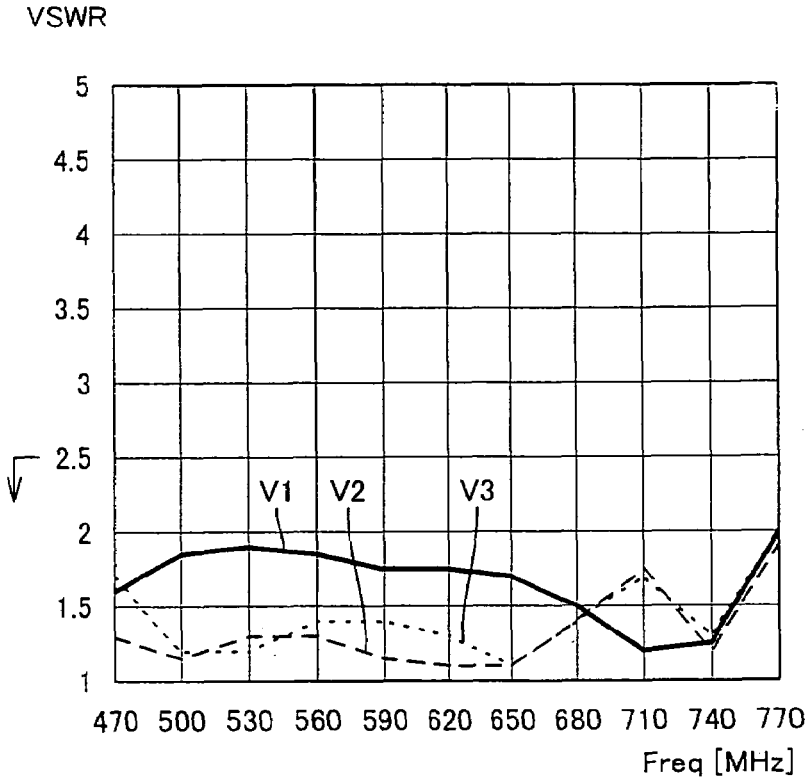
FIG. 8 is a graph representing a VSWR of antenna 1 of FIG. 1.

FIG. 8 is a graph representing antenna 1 of FIG. 1 in VSWR.

With reference to the figure, the horizontal axis represents a frequency range and the vertical axis represents VSWR. The frequency range is similar to that of FIG. 6, i.e., 470–770 MHz. Curves V1–V3 represent how antenna 1 of FIG. 1 and 14- and 8-Yagi antennas vary in VSWR.

A VSWR value of 2 or smaller is regarded as a level applicable to practical use without problem. Curves V1–V3 all indicate a VSWR value of two or smaller. Thus the present antenna provides a VSWR having a level applicable to practical use without problem.

Figure 9:
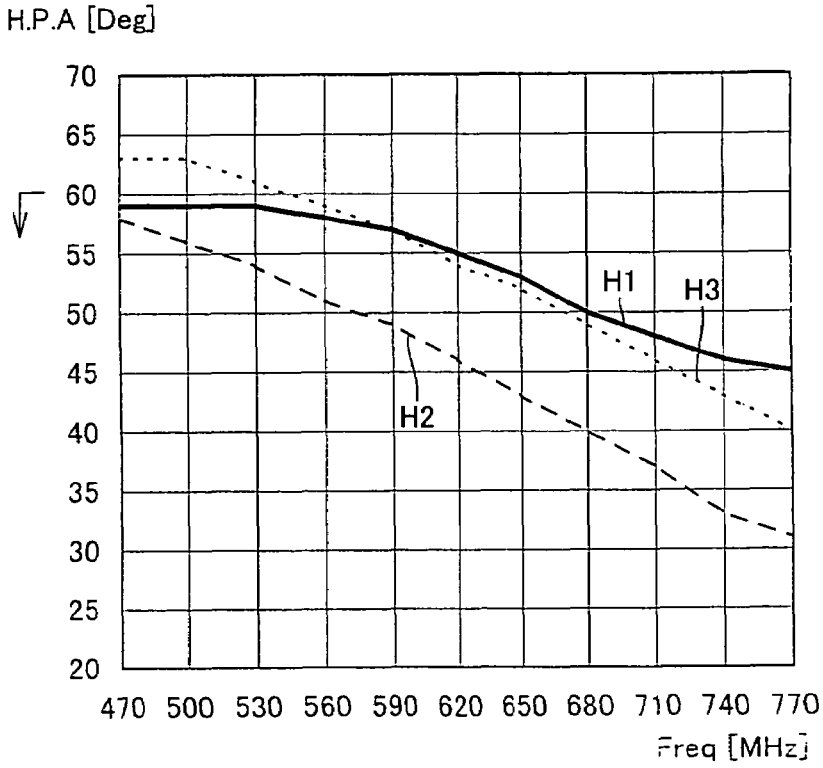
FIG. 9 is a graph representing a half-width of antenna 1 of FIG. 1.

FIG. 9 is a graph representing antenna 1 of FIG. 1 in half-width.

With reference to the figure, the horizontal axis represents a frequency range and the vertical axis represents half-width. The frequency range is similar to that of FIG. 6, i.e., 470–770 MHz. Curves H1–H3 represent how antenna 1 of FIG. 1 and 14- and 8-element Yagi antennas vary in half-width.

When curves H1 and H3 are compared, for a frequency in a range smaller than 470–590 MHz, curve H1 indicates a half width smaller than curve 3. As has been described above, for antennas used to receive digital terrestrial broadcasts, characteristics for lower band are important. The present antenna is also more suitable in half width than the 8-element Yagi antenna for receiving digital terrestrial broadcasts.

As shown in FIGS. 6–9, although antenna 1 of FIG. 1 is smaller in size than the 8-element Yagi antenna, as well as the 14-element Yagi antenna, antenna 1 can satisfy a level required to be accredited for the DH mark (i.e., a gain of at least 5.5 dB, a front-to-back ratio of at least 12 dB, a VSWR of at most 2.5, and a half width of at most 60 degrees). In other words, while antenna 1 is reduced in size to be smaller than the 8-element Yagi antenna, antenna 1 is equivalent in performance to the 14-element Yagi antenna.

Note that in the first embodiment the radiator is not limited to radiators 6A and 6B shown in FIG. 1. It is susceptible to a variety of variations in number, geometry, and the like. Hereinafter the first embodiment in an exemplary variation will be described.

Figure 10:
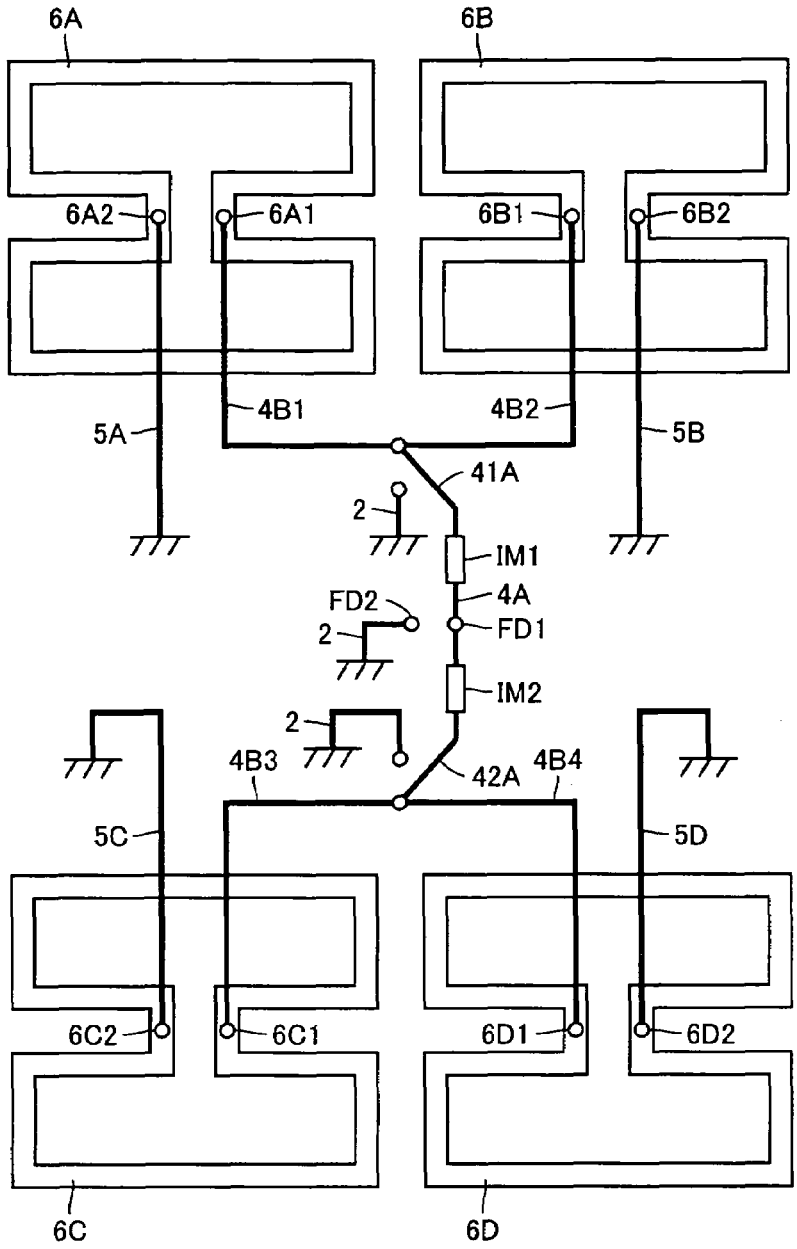
FIG. 10 is a block diagram of the antenna of the first embodiment in an exemplary variation.

FIG. 10 is a block diagram showing the antenna of the first embodiment in an exemplary variation.

With reference to FIGS. 5 and 10 the antenna of the first embodiment in this exemplary variation is similar to antenna 1 of FIG. 1 except that the former further includes radiators 6C and 6D each similar in performance to radiator 6A.

A transmission line 4B3 has one end connected to a feed point 6C1 and the other end to a transmission line 42A. Similarly, a transmission line 4B4 has one end connected to a feed point 6D1 and the other end to transmission line 42A.

Between transmission lines 4B1 and 4B2 and transmission line 4A a transmission line 41A and an impedance converter IM1 are provided. Similarly, between transmission lines 4B3 and 4B4 and transmission line transmission line 4A transmission line 42A and an impedance converter IM2 are provided. Transmission line 41A and impedance converter IM1 are included in the first matcher of the present invention and transmission line 42A and impedance converter IM2 are included in the second matcher of the present invention.

Transmission lines 41A and 42A both have an impedance of 75Ω. To allow the antenna at output terminal FD1 to have an impedance set at 75Ω, impedance converters IM1 and IM2 are provided. Impedance converters IM1 and IM2 will each have an input impedance of 75Ω and an output impedance of 150Ω.

Figure 11:
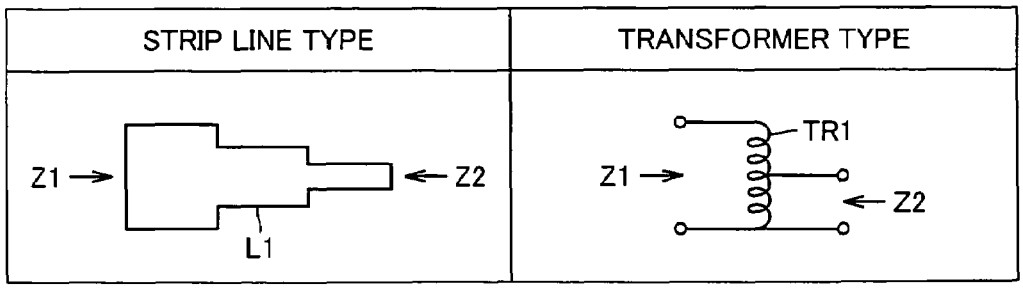
FIG. 11 shows an example of impedance converters IM1 and IM2 shown in FIG. 10.

FIG. 11 shows an example of impedance converters IM1 and IM2.

With reference to the figure, as an example in configuration of an impedance converter, examples configured of a strip line and a transformer, respectively, are shown. Note that in FIG. 11 impedances Z1 and Z2, for example for FIG. 10, will be 75Ω and 150Ω, respectively.

If an impedance converter is configured of a strip line L1, a varied line width provides a varied impedance. If the impedance converter is configured of a transformer TR1 then impedance is converted in accordance with impedance transformation ratio. For example, for impedance converters IM1 and IM2 shown in FIG. 10, the transformer will have a transformation ratio of 1:2.

Figure 12:
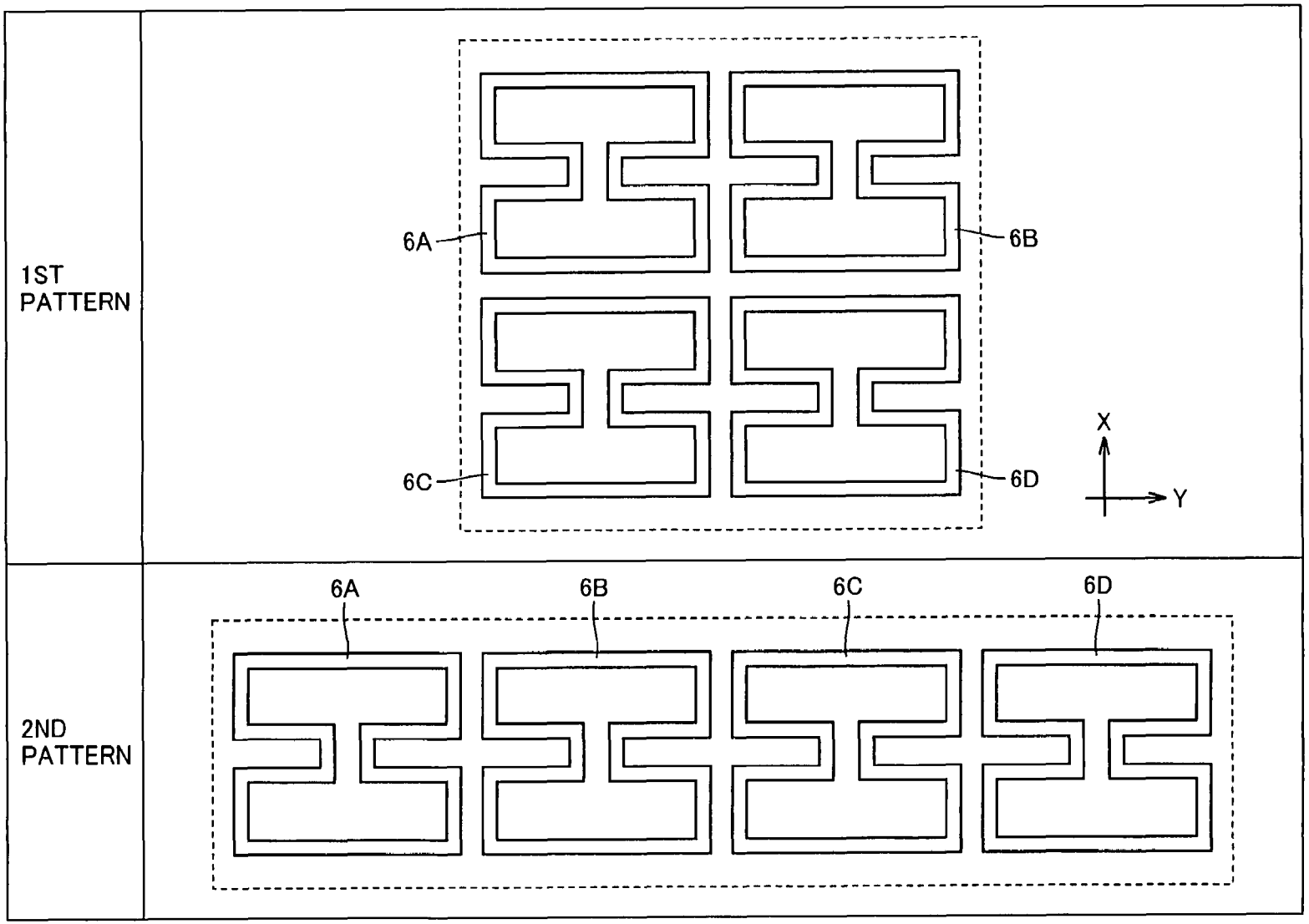
FIG. 12 shows an example of arranging a radiator shown in FIG. 10

FIG. 12 shows an example of arranging the radiator shown in FIG. 10.

With reference to the figure, two patterns of arranging radiators 6A–6D are shown. In a first pattern radiators 6A–6D are arranged on a plane determined by X and Y axes in two rows and two columns. Note that the X and Y axes of FIG. 12 are identical in direction to the X and Y axes, respectively, of FIG. 1. In a second pattern radiators 6A–6D are arranged in a plane determined by X and Y axes along the Y axis. More specifically, radiators 6A–6D are arranged in one row and four columns. Note that radiators 6A–6D are not limited to these patterns and may be arranged as appropriate in accordance with the size, performance and the like of the antenna.

Figure 13:
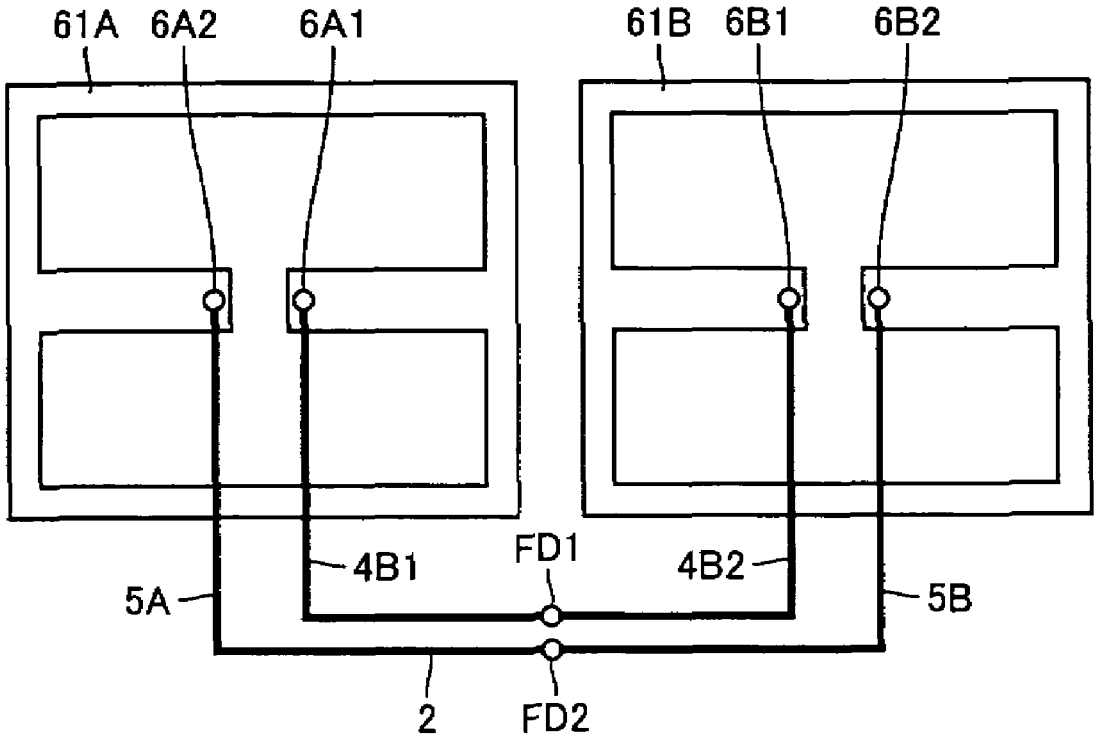
FIGS. 13 and 14 show the antenna of the first embodiment in another and still another exemplary variations, respectively.

FIG. 13 shows the antenna of the first embodiment in another exemplary variation.

With reference to the figure, radiators 61A and 61B are a 3-line, folded dipole antenna. In this regard, radiators 61A and 61B differ from radiators 6A and 6B, respectively, which are radiator in the form of two loop antennas combined together. The first embodiment in the exemplary variation except for the radiator is similar to antenna 1 of FIG. 1.

Radiators 61A and 61B are each designed to have an input impedance of 150Ω. As such, as well as in FIG. 5, the antenna at output terminal FD1 has an impedance of 75Ω, and the antenna can thus have output terminals FD1 and FD2 with a coaxial cable directly connected thereto.

Note that feed point 6A2 can be regarded as feed points R1As of the two radiator R1s of FIG. 4 that are overlapped and feed point 6A1 can be regarded as feed points R1Bs overlapped. Similarly, radiator 61B is similar to radiator 61A except that feed point 6A1 is replaced with feed point 6B1 and feed point 6A2 is replaced with feed point 6B2.

Figure 14:
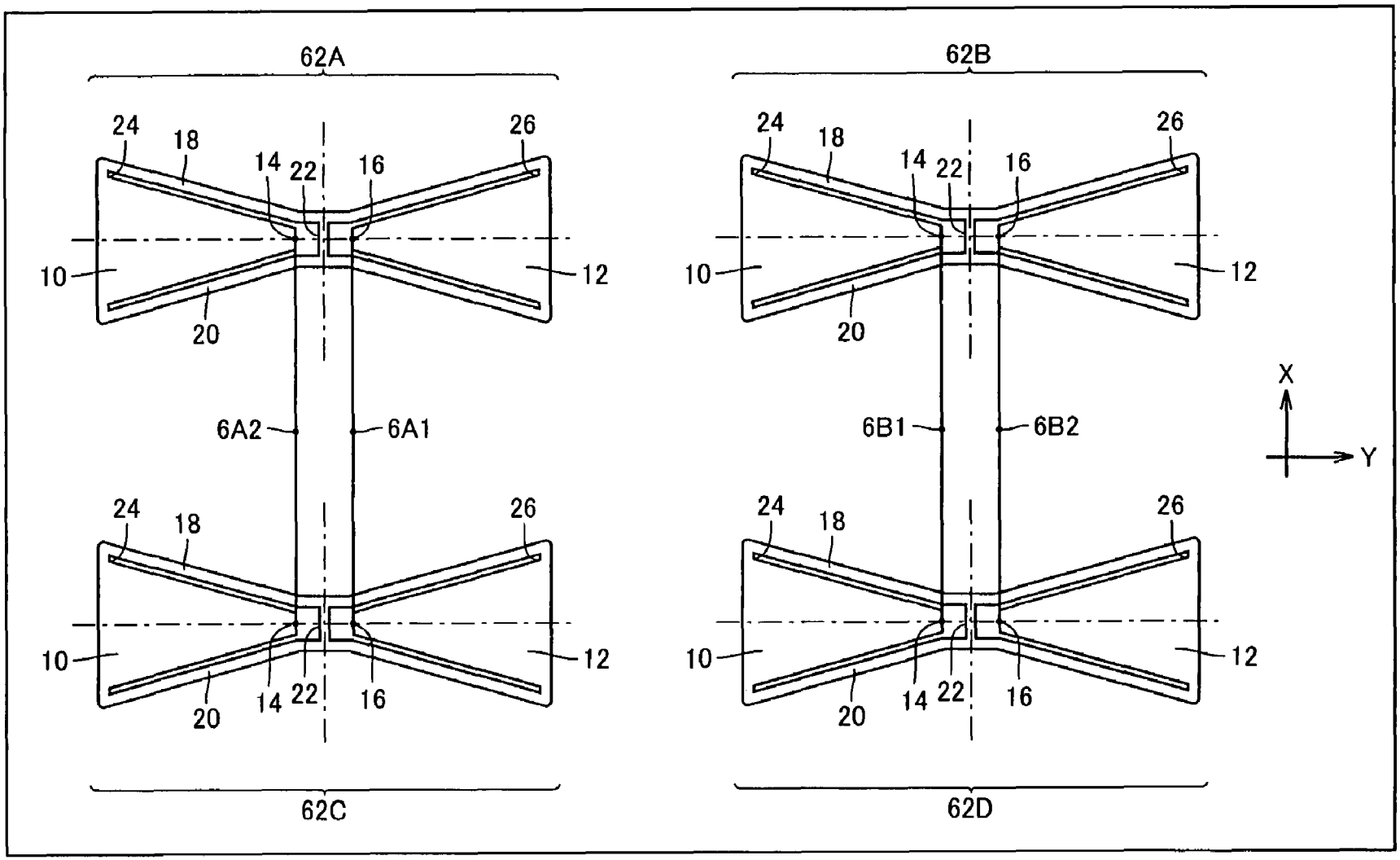

FIG. 14 is the antenna of the first embodiment in another exemplary variation.

With reference to the figure, a radiator 62A includes dipole elements 10 and 12 formed of conductor in the form of a plate. In the figure the X and Y axes correspond to the X and Y axes, respectively, of FIG. 1. Furthermore, dipole elements 10 and 12 have their respective feed points 14 and 16 provided on the Y axis. Furthermore, dipole elements 10 and 12 have a geometry symmetric with respect to the Y axis orthogonal to the X axis at a midpoint of a line segment connecting feed points 14 and 16. Dipole elements 10 and 12 each at least have a portion having an increasing dimension, as seen along of the Y axis, at locations farther away from the midpoint, as seen from the Y axis along the X axis. More specifically, dipole elements 10 and 12 each have a trapezoidal geometry.

Radiator 62A further includes a conductive line portions 18 and 20 arranged opposite with the X axis therebetween and together sandwiching dipole elements 10 and 12. Conductor line portions 18 and 20 each have one end connected to an end of dipole element 10 and the other end to an end of dipole element 12. Conductor line portions 18 and 20 are each formed to match the geometry of dipole elements 10 and 12.

Radiator 62A has a radiation impedance of 300Ω. Radiators 62B–62D has a geometry similar to radiator 62A.

Radiators 62A and 62C have their respective feed points 14 connected together and their respective feed points 16 connected together. A feed point 6A2 is provided at a midpoint of a line segment connecting feed points 14 together and a feed point 6A1 is provided at a midpoint of a line segment connecting feed points 16 together. Between radiators 62B and 62D feed points are connected together, as done between radiators 62A and 62C except that feed point 6A2 is replaced with feed point 6B1 and feed point 6A1 is replaced with feed point 6B2.

Thus in the first embodiment the first strip line with a reflector having a flat portion serving as a grounding plate and the second strip line perpendicular to the flat portion feed. Furthermore in the first embodiment each strip has an impedance set to be twice that of a coaxial cable. Thus in the first embodiment the coaxial cable can be connected to an output terminal of an antenna that is a midpoint of the first strip line. Matching and mixing losses can be prevented and an antenna smaller in size than superior in performance than conventional can be achieved.

Second Embodiment

Figure 15:
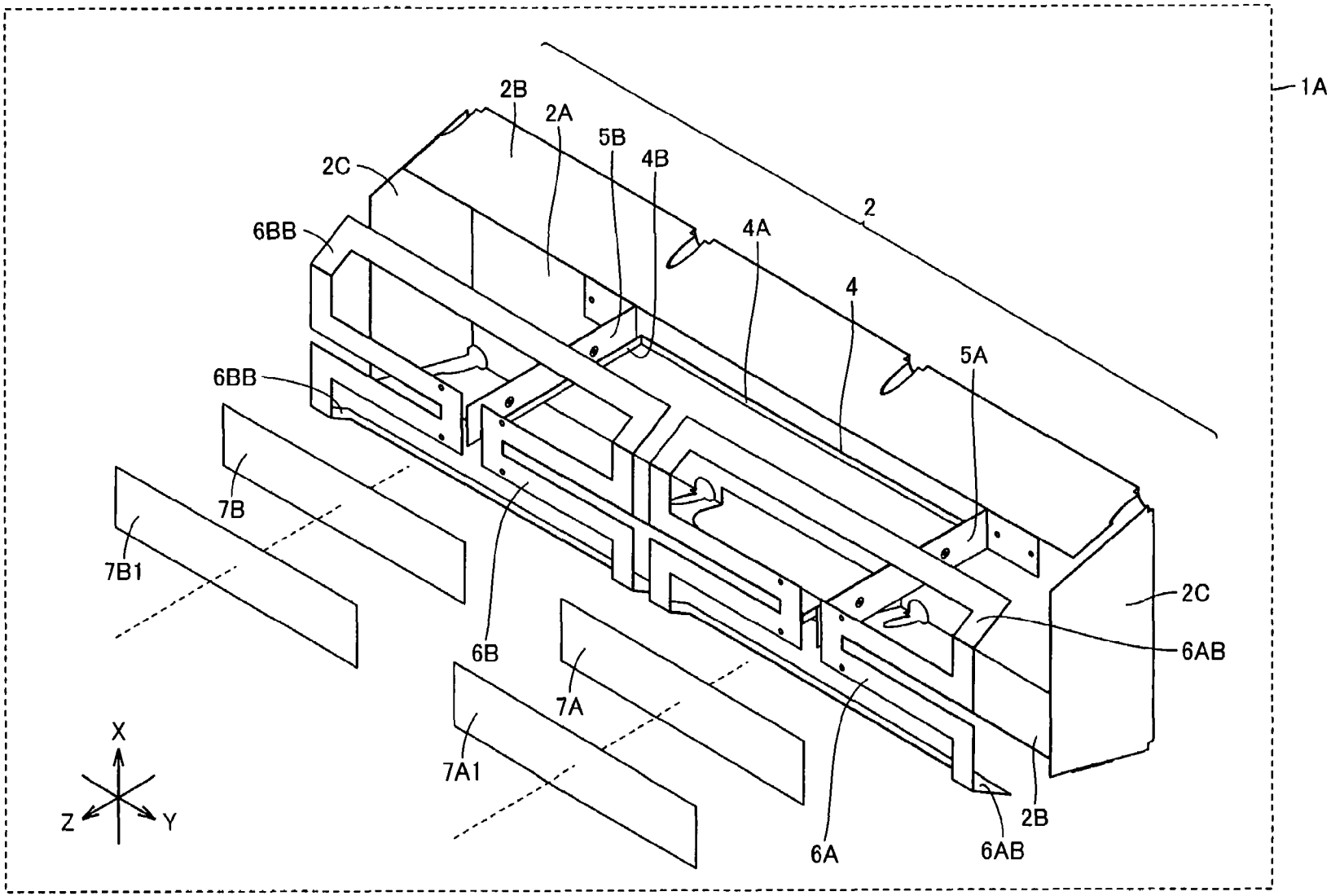
FIG. 15 shows the present antenna in a second embodiment.

FIG. 15 shows the present antenna in a second embodiment.

With reference to the figure, an antenna 1A is similar to antenna 1 except that the former includes directors 7A1 and 7B1 implemented by conductive plates.

Directors 7A and 7A1 are arranged in parallel and cooperate with flat portion 2A to sandwich radiator 6A associated therewith. Similarly, directors 7B and 7B1 and are arranged in parallel and cooperate with flat portion 2A to sandwich radiator 6B associated therewith. The plurality of directors thus provided allows the antenna to be enhanced in performance. Note that while directors 7A and 7A1 are arranged parallel to radiator 6A and directors 7B and 7B1 are arranged parallel to radiator 6B, directors 7A, 7A1, 7B, 7B1 may be arranged at an appropriate angle relative to each radiator.

Figure 16:
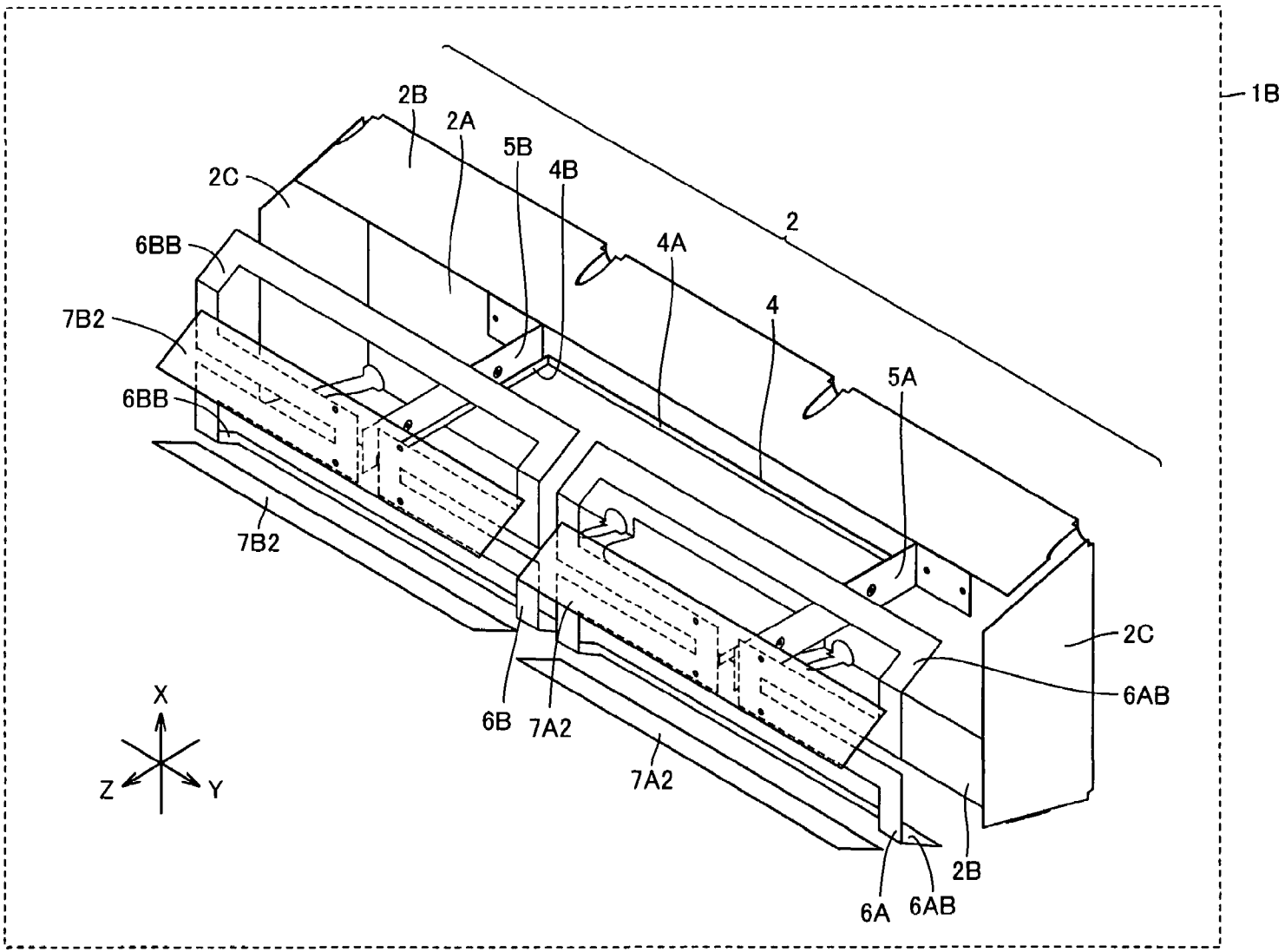
FIG. 16 shows the antenna of the second embodiment in an exemplary variation.

FIG. 16 is the present antenna of the second embodiment in an exemplary variation.

With reference to the figure, an antenna 1B is similar to antenna 1A of FIG. 15 except that the former includes directors 7A2, 7B2 instead of directors 7A, 7A1, 7B, 7B1.

Director 7A2 is arranged in front of and substantially parallel to a radiation plane, or an end 6AB, of radiator 6A. Similarly, director 7B2 is arranged in front of and substantially parallel to an end 6BB of radiator 6B. Note that while FIG. 16 shows one director provided for each radiation plane (i.e., two directors for each radiator), a plurality of directors may be arranged to overlap in a plane parallel to each radiation plane, as shown in FIG. 15.

Thus in the second embodiment a plurality of directors can be provided to provide an antenna enhanced in performance.

Third Embodiment

Figure 17:
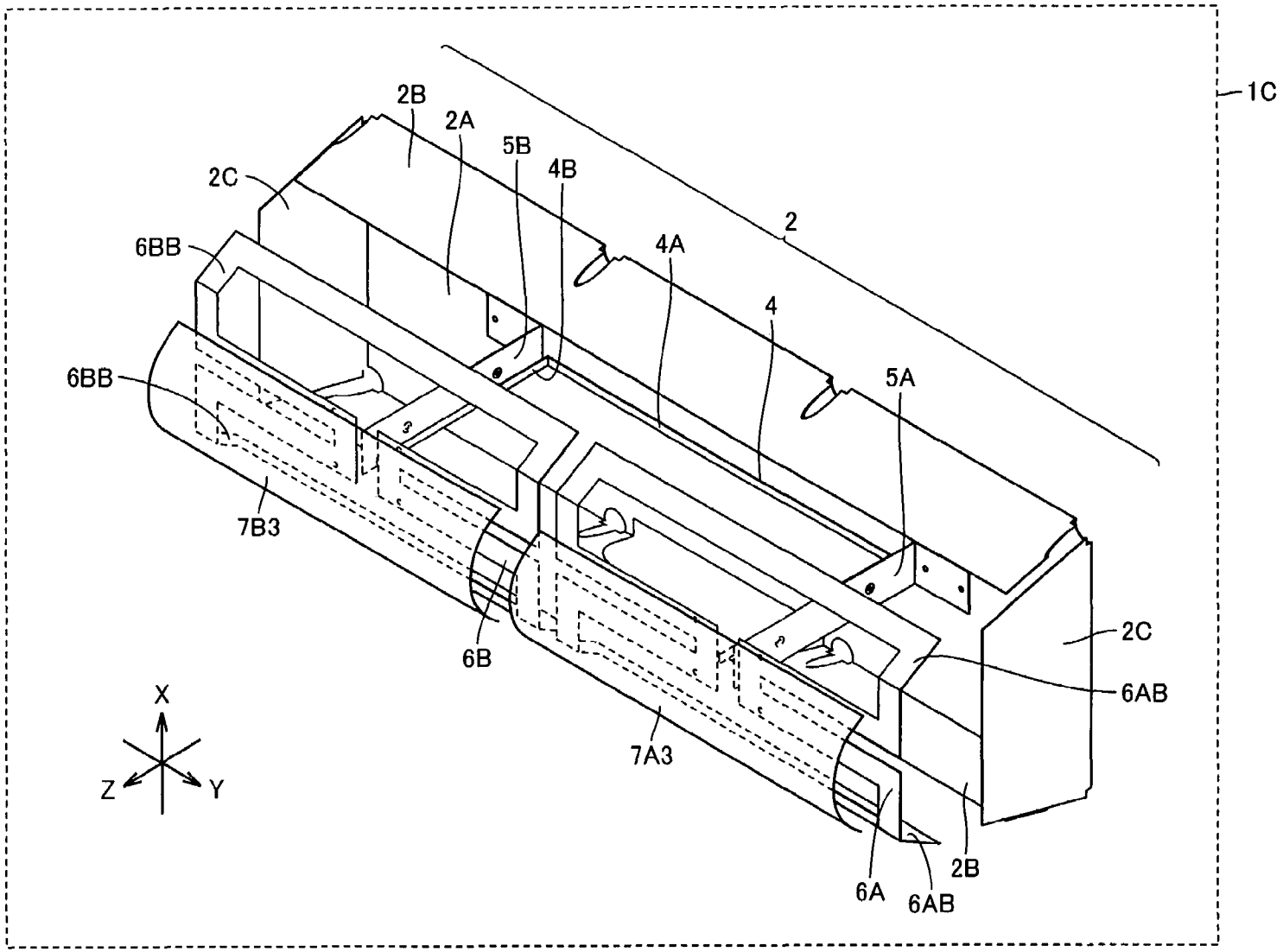
FIG. 17 is an overall view of the present antenna in a third embodiment.

FIG. 17 is an overall view of the present antenna in a third embodiment.

With reference to the figure, an antenna 1C is similar to antenna 1 of FIG. 1 except that the former includes directors 7A3 and 7B3 instead of directors 7A and 7B.

Directors 7A3 and 7B3 each have a center and an end having different distances, respectively, from flat portion 2A. In FIG. 17, the distance between the end and flat portion 2A is smaller than that between the center and flat portion 2A. More specifically, directors 7A3 and 7B3 are both in the form of the letter U or an arc as seen in the direction of the Y axis. Directors 7A3 and 7B3 thus formed can have a smaller dimension along the X axis. Antenna 1C can thus have a reduced size.

Note that directors 7A3 and 7B3 are not limited in geometry to that shown in FIG. 17. Hereinafter an exemplary variation of the third embodiment will be described in connection with the director's geometry.

Figure 18:
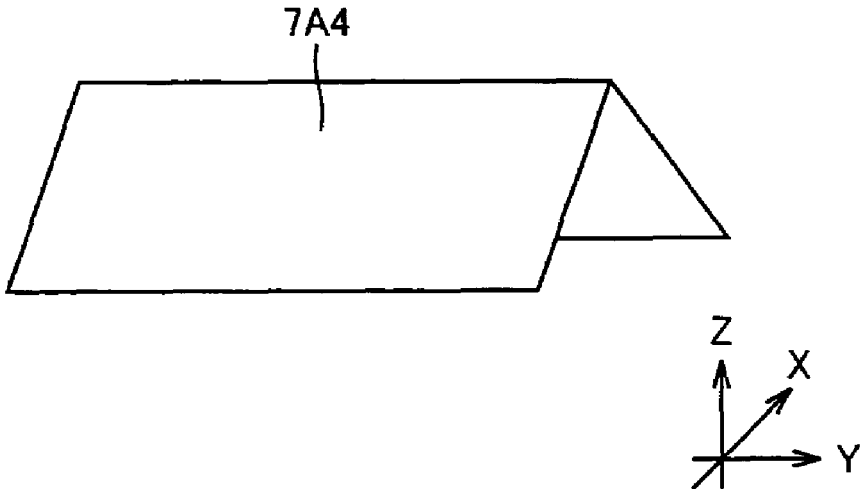
FIGS. 18 and 19 show a director 7A3 of FIG. 17 in an exemplary and another exemplary variations, respectively.

FIG. 18 shows director 7A3 of FIG. 17 in an exemplary variation.

With reference to the figure, a director 7A4 is similar to director 7A3 of FIG. 17 except that the former is bent in the form of the letter V as seen along the Y axis. Note that the X, Y and Z axes of FIG. 18 correspond in direction to the X, Y and Z axes, respectively, of FIG. 17.

Figure 19:
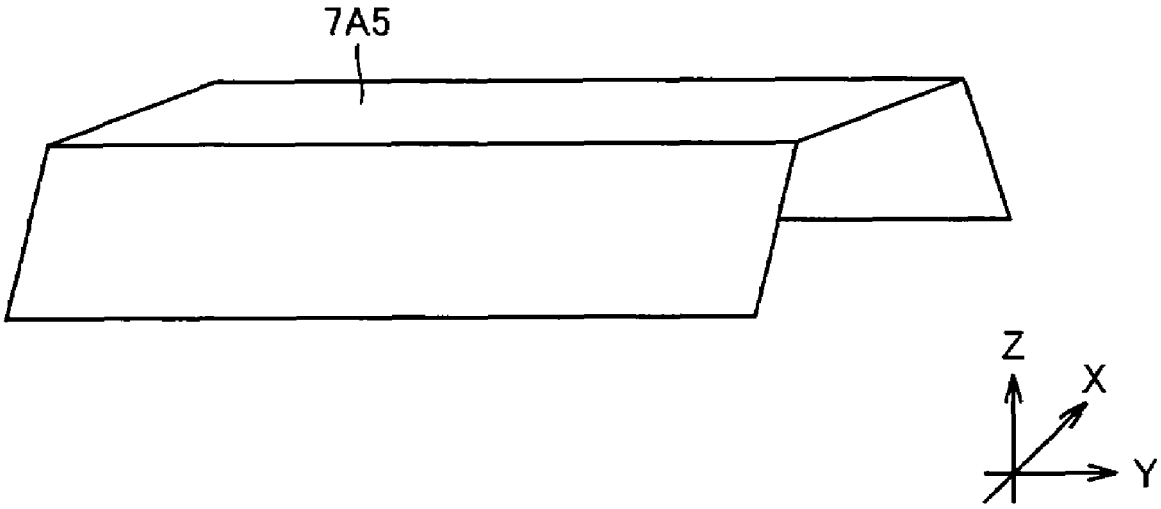

FIG. 19 shows director 7A3 of FIG. 17 in an another exemplary variation.

With reference to the figure, a director 7A5 is similar to director 7A3 of FIG. 17 except that the former is formed to be a trapezoid as seen along the X axis. As well as in FIG. 18, the X, Y and Z axes of FIG. 19 correspond in direction to the X, Y and Z axes, respectively, of FIG. 17. Director 7A4 has a geometry along a surface of radiator 6A.

Note that while in FIGS. 17–19 the director is shown to be bent in a direction opposite to that of reflection, the director may be formed to be bent in the direction of reflection, although to reduce the dimension along the Z axis the director is preferably formed to be bent in the direction opposite to that of reflection.

Thus the third embodiment allows the director to be formed to be bent in a direction of a plane of reflection or a direction opposite to that of the plane of reflection to provide an antenna reduced in size.

Fourth Embodiment

Figure 20:
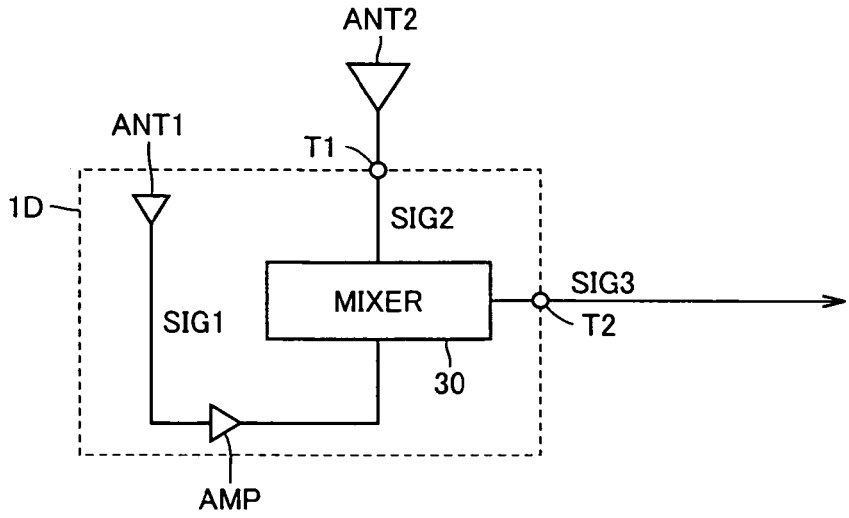
FIG. 20 is a block diagram of the present antenna in a fourth embodiment.

FIG. 20 is a block diagram of the present antenna in a fourth embodiment.

With reference to the figure, an antenna ID includes antenna ANT1 receiving an electric wave of the UHF band. Antenna ANT1 is any of those of the first to third embodiments.

Antenna ID is connected via a terminal T1 to antenna ANT2 which is for example a BS antenna, a BS-110° CS antenna, a CS antenna, or the like.

Antenna ID also includes an amplifier AMP amplifying a signal SIG1 received by antenna ANT1, and a mixer 30 mixing a signal output from amplifier AMP and a signal SIG2 received by antenna ANT2 together to output a signal SIG3. Signal SIG3 is output at a terminal T2 externally and transmitted for example to a receiver for example of a digital tuner (not shown in FIG. 20).

If antenna ID does not include the mixer, the receiver has a cable connected thereto to receive signals from antennas ANT1 and ANT2. This requires an effort to connect the cable as well as a space for installing the mixer. Antenna ID having mixer 30 incorporated therein can overcome such disadvantages.

Note that antenna ID may not include amplifier AMP. In that case, signal SIG1 is directly input to mixer 30. Furthermore, antenna ID may be configured to include only antenna ANT1 and amplifier AMP.

Thus the fourth embodiment provides an antenna having a mixer incorporated therein to allow a receiver to have a reduced number of cables connected thereto and can also prevent increased numbers of locations for installation.

Furthermore in the forth embodiment an amplifier can amplifies a received electric wave to allow the antenna to output a signal having a level of intensity required for a process performed in the receiver.

Fifth Embodiment

A fifth embodiment provides an antenna different from those of the first to third embodiments in that the former is provided with a connector for electrically connecting a cable and an output terminal of the antenna. Note that the antenna of the fifth embodiment is similar in configuration to antenna 1 of FIG. 1. It should be noted, however, that the antenna of the fifth embodiment may be similar in configuration to antenna 1A. Furthermore, the antenna of the fifth embodiment may be similar in configuration to antenna 1B.

As has been described above, transmission line 4A has a midpoint serving as the output terminal of the antenna. Accordingly, the connector has an electrode connected to the midpoint of transmission line 4A. Furthermore, the connector is provided at reflector 2. Reflector 2 is formed of flat portion 2A and peripheral portions 2B and 2C, of which flat portion 2A is located closest to transmission line 4A. If the connector is attached to flat portion 2A, the connector can be connected directly to the midpoint of transmission line 4A. This can prevent a loss of an output.

If antenna 1 is installed outdoors, however, antenna 1 is fixed by employing a mast, which is typically attached to flat portion 2A, and if the connector is attached to flat portion 2A there is a high possibility that the cable cannot readily be connected, drawn and the like.

Attaching the connector to reflector 2 at a bottom surface can resolve such problem and thus reduce an effort required to connect the cable. Attaching the connector to reflector 2 at the bottom surface is also preferable in terms of waterproof.

Reflector 2 at the bottom surface, as referred to herein, indicates a peripheral portion surrounding flat portion 2A that contacts a side lower than transmission line 4A when antenna 1 is installed. In FIG. 1, of the two peripheral portions 2Bs, that provided in the negative X direction with respect to transmission line 4A corresponds to the bottom surface of reflector 2.

Peripheral portion 2B and transmission line 4A have a distance therebetween lager than flat portion 2A and transmission line 4A have. Accordingly in the fifth embodiment the following method is employed to connect a connector and a transmission line.

Figure 21:
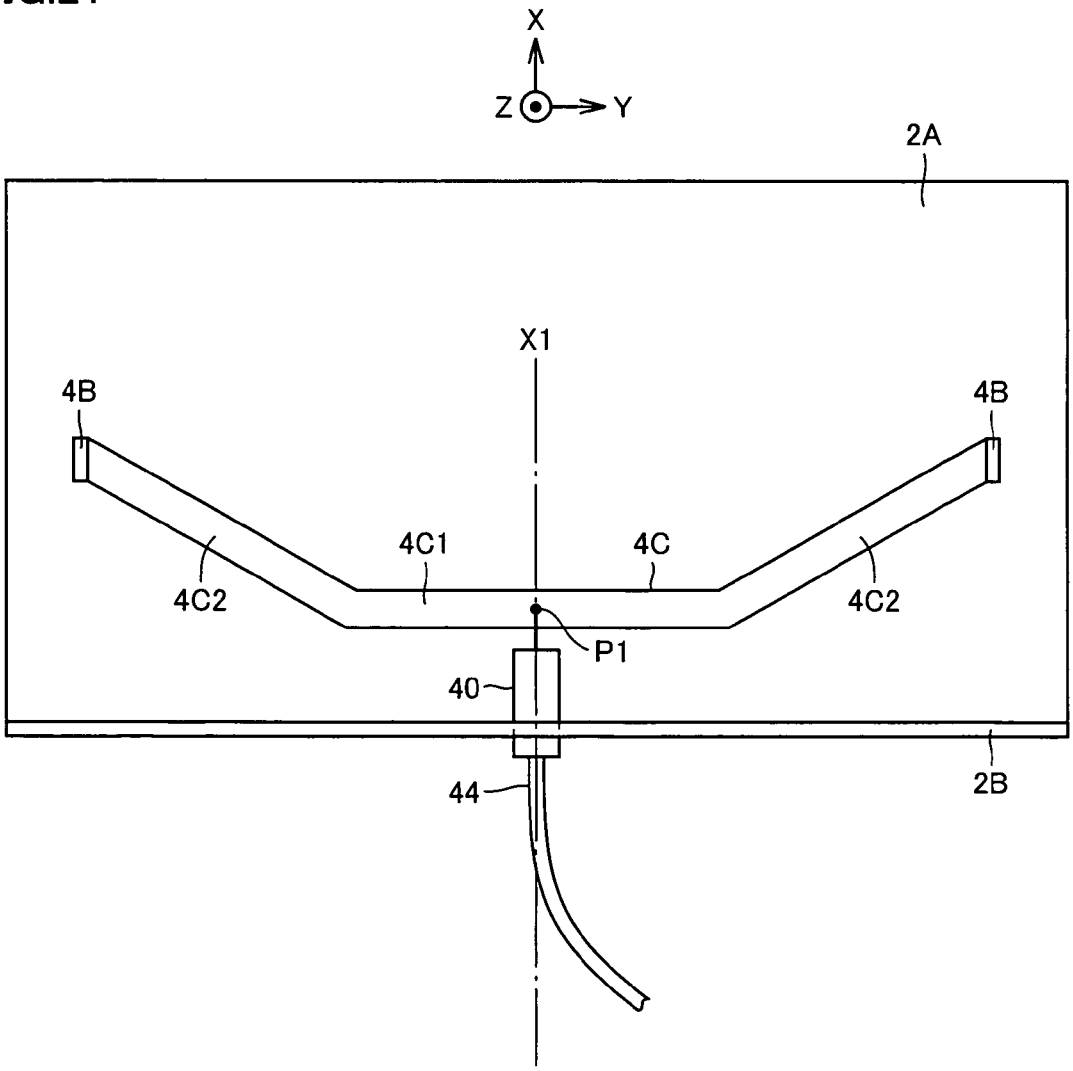
FIGS. 21 and 22 show one and another examples, respectively, of connecting a connector and a transmission line.

FIG. 21 shows one example of connecting the connector and the transmission line.

With reference to the figure, a transmission line 4C is a transmission line provided instead of transmission line 4A to antenna 1 of FIG. 1. As shown in FIG. 1, transmission line 4A is a linear transmission line extending along the Y axis. In contrast, transmission line 4C has a geometry of transmission line 4A that is bent in the direction of the Z axis in FIG. 1. Transmission line 4C having such geometry allows a shorter distance to the connector than transmission line 4A. Thus transmission line 4C can directly be connected to the connector and the antenna can thus provide an output without loss.

Transmission line 4C includes a conductive line portion 4C1 and two conductive line portions 4C2s. Conductive line portion 4C1 is connected to a connector 40 directly. The two conductive line portions 4C2s are connected to two transmission lines 4Bs, respectively.

Connector 40 is attached to peripheral portion 2B at an intersection with an axis X1 passing through a point P1 and perpendicular to conductive line portion 4C1. Point P1 is a midpoint of transmission line 4C. Therefore, point P1 corresponds to an output terminal of the antenna. Furthermore, axis X1 has a direction along the X axis shown in FIG. 1. Connector 40 has a coaxial cable 44 connected thereto.

Transmission line 4C has its length, width and the like and its distance to flat portion 2A set to allow point P1 to provide an impedance for example of 75Ω. Typically a coaxial cable has an impedance of 75Ω. As such, the manner of connection shown in FIG. 21 allows transmission line 4C and coaxial cable 44 to match in impedance. The antenna can thus provide an output without loss.

Figure 22:
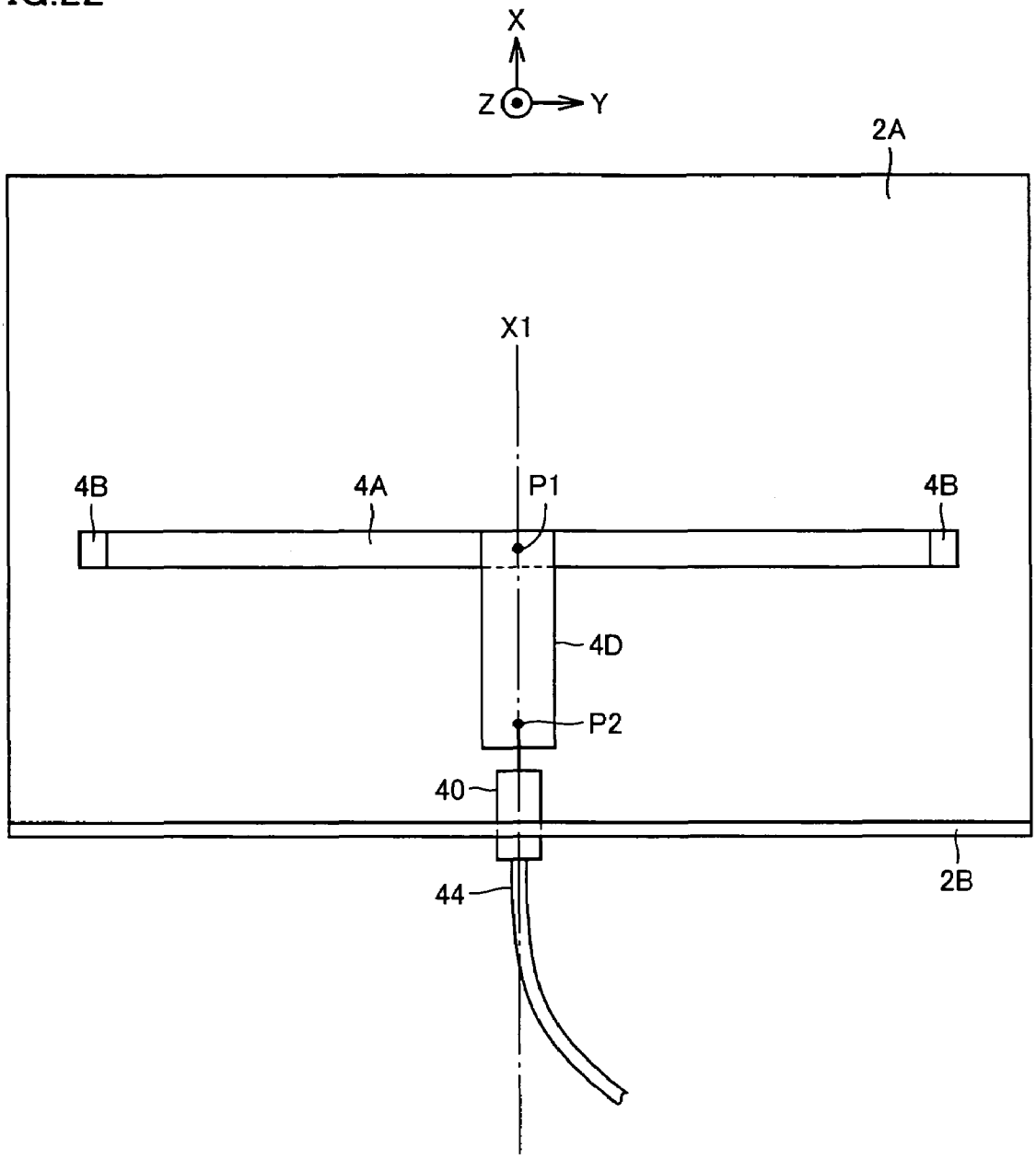

FIG. 22 shows another example of connecting a connector and a transmission line.

With reference to the figure, a conductive line portion 4D is provided to connect transmission line 4A and connector 40. Axis X1 passes through point P1 and is perpendicular to transmission line 4A. Point P1 is a midpoint of transmission line 4A. Furthermore, axis X1 has a direction along the X axis shown in FIG. 1. As described with reference to FIG. 21, connector 40 is provided at peripheral portion 2B at an intersection with axis X1.

Conductive line portion 4D has a symmetrical geometry with respect to axis X1. Furthermore, connector 40 and conductive line portion 4D are connected at a point P2 located at conductor line 4D and overlapping axis X1.

Transmission line 4D has its length, width and the like set to allow point P2 to provide an impedance for example of 75Ω. Thus the manner of connection shown in FIG. 22 allows transmission line 4A and coaxial cable 44 to match in impedance. The antenna can thus provide an output without loss.

If antenna 1 internally has a sufficiently large space, antenna 1 can have transmission line 4A replaced with transmission line 4C. Transmission line 4C having a bent geometry, however, may not be accommodated in antenna 1. In such a case, antenna 1 can have conductive line portion 4D added thereto to allow a connector provided at peripheral portion 2B and transmission line 4A to be connected together. The antenna can thus provide an output without loss.

Note that the connector and the transmission line may be connected in a manner other than those shown in FIGS. 21 and 22, although the connector must be provided on an axis passing the midpoint of the transmission line and perpendicular to the transmission line and also be electrically connected to the midpoint of the transmission line.

As shown in FIGS. 21 and 22, the antenna of the fifth embodiment differs from that of the first embodiment in the configuration of the transmission line. The transmission line changed in configuration causes a possibility of reduced gain and other performance. The antenna of the fifth embodiment can be provided with a radiator, as will be described hereinafter, to prevent impaired performance.

Figure 23:
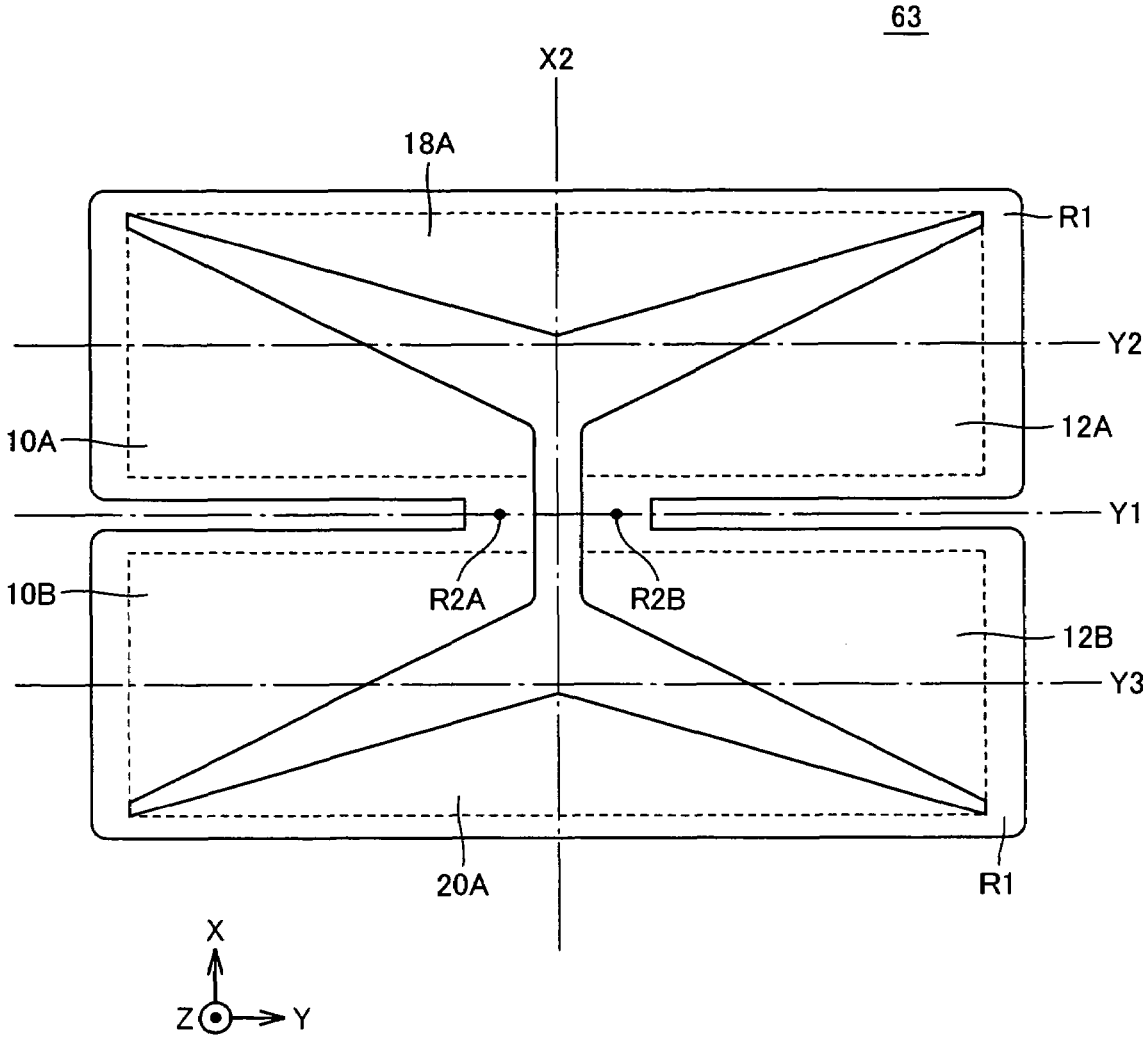
FIG. 23 shows an example of a radiator applied to the present antenna in a fifth embodiment.

FIG. 23 shows an example of a radiator applied to the antenna of the fifth embodiment.

With reference to the figure, a radiator 63 includes two radiators R1s, as described for radiator R2 (a loop antenna) of FIG. 4. As has been described above, radiator R1 is a loop antenna. Feed points R2A and R2B correspond to feed points R2A and R2B, respectively, shown in FIG. 4. In other words, feed points R2A and R2B are first and second feed points, respectively.

Note that in FIG. 23 an axis Y1 passes feed points R2A and R2B. Furthermore, an axis Y2 is perpendicular to axis Y1. Axes X2 and Y1 provide an intersection, which corresponds to a midpoint of a line segment connecting feed points R2A and R2B together. Note that axes X2 and Y1 are axes extending along the X and Y axes, respectively, shown in FIG. 1.

Radiator R1 at least has a portion formed to be increased in width, as seen in the direction of axis X2, at locations farther away from the midpoint along axis Y1. In this regard, radiator 63 differs from radiator R2.

Furthermore, radiator 63 is substantially similar in geometry to each of radiators 62A–62D shown in FIG. 14. More specifically, regions 10A and 10B correspond to dipole element 10 of radiator 62A. Regions 12A and 12B correspond to dipole element 12 of radiator 62A. A region 18A corresponds to conductive line portion 18 of radiator 62A. A region 20A corresponds to conductive line portion 20 of radiator 62A. Region 18A is formed along a portion of a perimeter of region 10A, 12A. Region 20A is formed along a portion of a perimeter of region 10B, 12B.

Radiator 63 including regions 10A, 10B, 12A, 12B, 18A, 20A allows a higher gain than radiator R2. As such, if in the fifth embodiment the antenna has the transmission line changed in configuration, it can still be prevented from having reduced gain.

As has been described above, radiator 63 is substantially similar in geometry to radiator 62A. Accordingly, radiator 62A may be employed in the antenna of the fifth embodiment. This can also prevent the antenna of the fifth embodiment with the transmission line changed in configuration from accordingly having a reduced gain.

Note that radiator 63 may be bent along axes Y2, Y3. It can have a reduced dimension along the X axis. Antenna 1 can thus be reduced in size.

Figure 24:
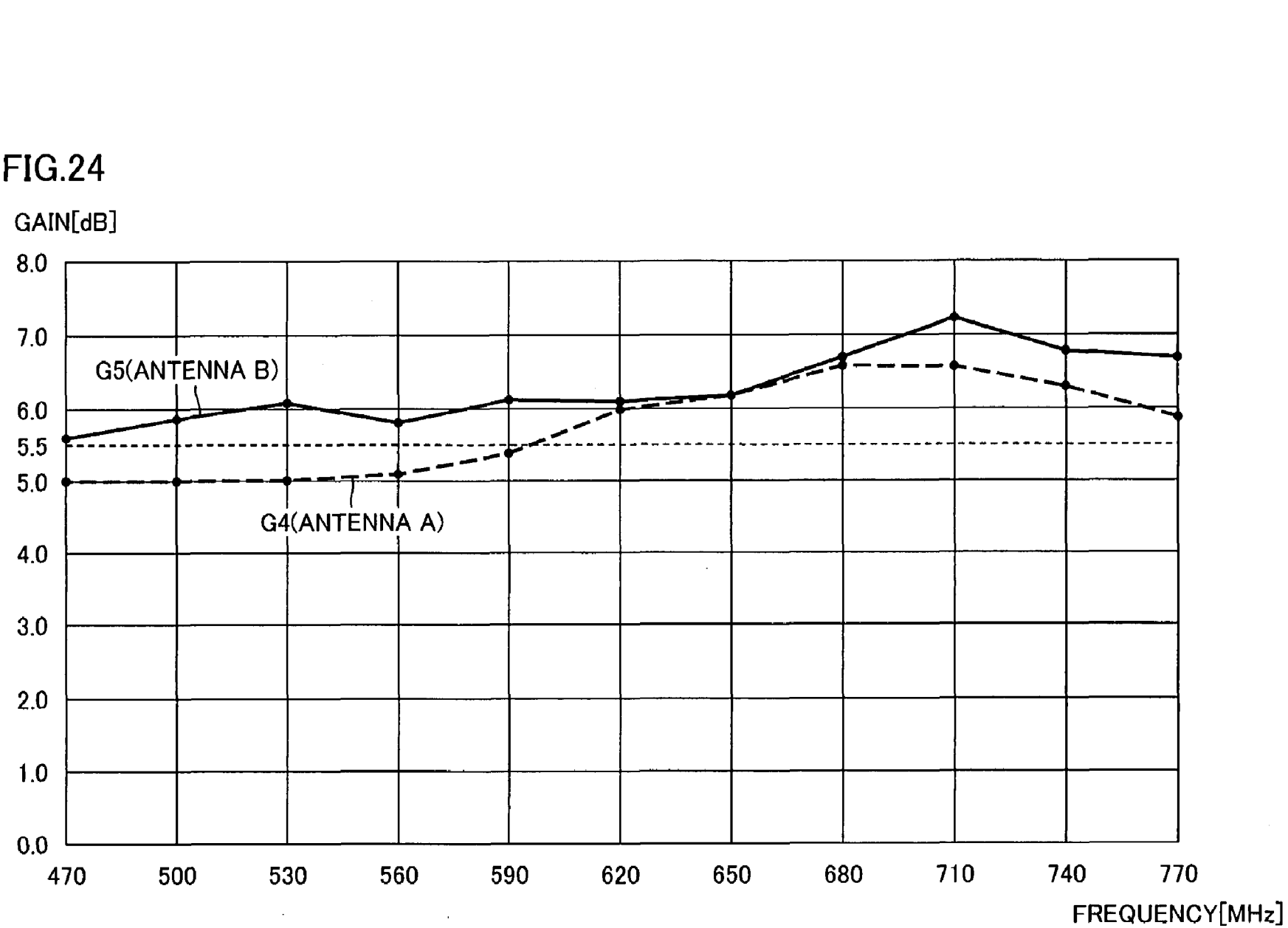
FIG. 24 represents a gain of the antenna of the fifth embodiment.
Figure 25:
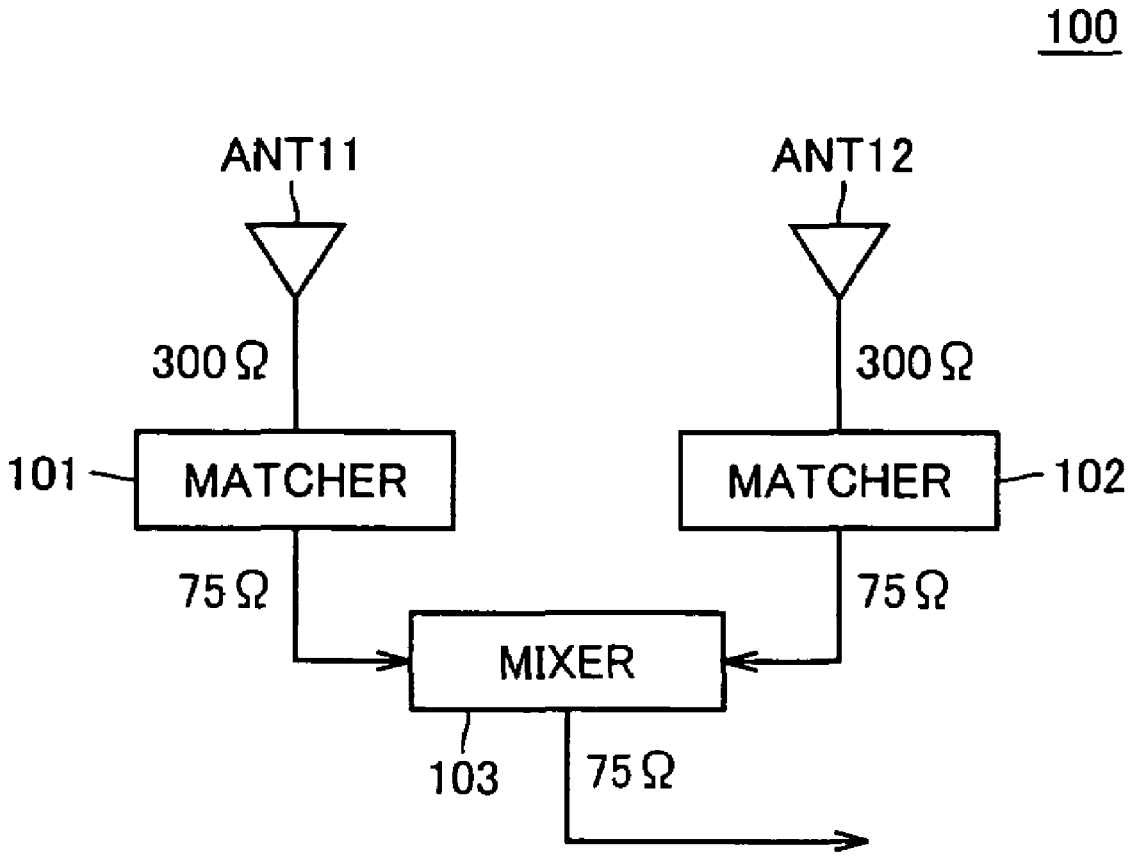
FIG.25 PRIOR ART
FIG. 25 shows a configuration of a stacked antenna by way of example.

FIG. 24 represents the antenna of the fifth embodiment in gain.

With reference to the figure, the graph has a horizontal axis representing frequency, and a vertical axis representing the gain of the antenna. Curves G4 and G5 represent how two antennas having their respective radiators different in geometry (hereinafter referred to as antennas A and B) vary in gain.

Antenna A is similar to antenna 1 of FIG. 1 except that transmission line 4A is replaced with transmission line 4C and peripheral portion 2B is provided with a connector. Antenna B is similar to antenna A except that radiators 6A and 6B are each replaced with radiator 63.

As indicated by curves G4 and G5, for a frequency ranging from 470 to 590 MHz, antenna B provides a gain higher than antenna A. Furthermore, when compared with curve G1 shown in FIG. 6, for the frequency ranging from 470–590 MHz, antenna A provides a gain lower than antenna 1. In other words, antenna 1 having transmission line 4A replaced with transmission line 4C provides a reduced gain. However, by replacing radiators 6A and 6B each with radiator 63, the antenna of the fifth embodiment can have a level in performance equivalent to antenna 1.

Thus the fifth embodiment can provide an antenna that can reduce an effort required to connect a cable and is superior in performance than conventional.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna comprising:

a reflector formed of conductor and having a flat portion reflecting a prescribed electric wave;

a first transmission line facing said flat portion with a prescribed distance therebetween;

a plurality of radiators each formed of conductor and arranged on a same side as said first transmission line relative to said flat portion, said plurality of radiators each having first and second feed points arranged to have a distance from said flat portion larger than said prescribed distance;

a plurality of second transmission lines associated with said plurality of radiators, respectively, and electrically connecting said first feed point and said first transmission line together; and a plurality of conductive plates arranged parallel to said plurality of second transmission lines, respectively, and electrically connecting said second feed point and said flat portion together, said plurality of conductive plates, as seen along said second transmission line, having a surface facing said second transmission line and larger in width than said second transmission line.

2. The antenna according to claim 1, wherein each of said second transmission lines and each of said plurality of conductive plates are arranged perpendicular to said flat portion.

3. The antenna according to claim 2, wherein said plurality of conductive plates are each arranged outer than said second transmission line with respect to an axis passing a midpoint of said first transmission line and perpendicular to said flat portion and if said second feed point is located more adjacent to said axis than said first feed point said plurality of conductive plates are each electrically connected to said second feed point such that that portion of said conductive plate which is connected to a corresponding one of said radiators traverses said second transmission line.

4. The antenna according to claim 1, further comprising a plurality of directors associated with said plurality of radiators, respectively, and formed of conductor.

5. The antenna according to claim 4, wherein:

each of said plurality of directors and said flat portion sandwich a corresponding one of said radiators; and each of said plurality of directors includes a plurality of parallel conductive plates.

6. The antenna according to claim 4, wherein:

said plurality of radiators each include first and second radiation planes symmetrical with respect to an axis including a line segment connecting said first and second feed points; and said plurality of directors are each provided for each said first and second radiation planes to face each of said first and second radiation planes.

7. The antenna according to claim 4, wherein said plurality of directors each include a center and an end adjacent to said center and at least having a portion having a distance from said flat portion different from that between said center and said flat portion.

8. The antenna according to claim 1, wherein:

said plurality of radiators are two radiators both having an input impedance of a prescribed value multiplied by two;

said plurality of second transmission lines are two conductive lines both having a characteristic impedance of said prescribed value multiplied by two; and said first transmission line has a characteristic impedance of said prescribed value multiplied by two, and has both ends connected to said two conductive lines, respectively, and a midpoint provided with an output terminal of the antenna.

9. The antenna according to claim 8, wherein said two radiators each include first and second dipole elements having third and fourth feed points;

said first and second dipole elements are provided such that said third feed points overlap and said fourth feed points overlap or such that said third feed points are adjacent to each other and said fourth feed points are adjacent to each other; and said first feed point is one of: said third feed points overlapping; and a point on a line segment connecting adjacent ones of said third feed points together, and said second feed point is one of: said fourth feed points overlapping; and a point on a line segment connecting adjacent ones of said fourth feed points together.

10. The antenna according to claim 9, wherein said first and second dipole elements are each formed to at least have a portion increasing in dimension, as seen in a direction perpendicular to said axis, at locations further away from a midpoint of a line segment connecting said third and fourth feed points and along an axis passing through said third and fourth feed points.

11. The antenna according to claim 10, wherein said reflector further has a peripheral portion surrounding said flat portion that is in contact with a side located lower than said first transmission line with the antenna installed and forms a prescribed angle other than 180° relative to said flat portion;

the antenna further comprises a connector electrically connecting to said midpoint of said first transmission line a cable transmitting an output;

said connector is arranged at said peripheral portion at an intersection with an axis passing through said midpoint and perpendicular to said first transmission line.

12. The antenna according to claim 1, wherein:

said plurality of radiators each include first and second dipole elements; and said first and second dipole elements each have third and fourth feed points and at least have a portion increasing in dimension, as seen in a direction perpendicular to said axis, at locations further away from a midpoint of a line segment connecting said third and fourth feed points and along an axis passing through said third and fourth feed points.

13. The antenna according to claim 1, wherein:

said plurality of radiators are four radiators each having an input impedance of a prescribed value multiplied by two;

said plurality of second transmission lines are four conductive lines each having a characteristic impedance of said prescribed value multiplied by two;

the antenna further comprises a first matcher matching first and second ones of said four conductive lines and said first transmission line in impedance, and a second matcher matching third and fourth ones of said four conductive lines and said first transmission line in impedance;

said first transmission line has a characteristic impedance of said prescribed value multiplied by two and also have a midpoint provided with an output terminal of the antenna; and said first transmission line has one and the other ends connected to said first and second matchers, respectively.

14. The antenna according to claim 13, wherein:

said four radiators each include first and second dipole elements having third and fourth feed points;

said first and second dipole elements are provided such that said third feed points overlap and said fourth feed points overlap or such that said third feed points are adjacent to each other and said fourth feed points are adjacent to each other; and said first feed point is one of: said third feed points overlapping; and a point on a line segment connecting adjacent ones of said third feed points together, and said second feed point is one of said fourth feed points overlapping; and a point on a line segment connecting adjacent ones of said fourth feed points together.

15. The antenna according to claim 1, wherein said reflector at a portion thereof surrounding said flat portion at least has a portion having a peripheral portion in contact with said flat portion, said peripheral portion forming a prescribed angle other than 180° relative to said flat portion.

16. The antenna according to claim 1, wherein said plurality of radiators each include a center and an end at least having a portion having a distance from said flat portion different from that between said center and said flat portion.

17. The antenna according to claim 1, wherein:

said first transmission line and said flat portion form a first strip line with said flat portion serving a grounding plate; and said plurality of second transmission lines and ones of said plurality of conductive plates corresponding to said plurality of second transmission lines, respectively, form a plurality of second strip lines with said ones of said plurality of conductive plates serving as a grounding plate.

18. The antenna according to claim 1, further comprising a mixer mixing together said prescribed electric wave received and an electric wave of a frequency band different from said prescribed electric wave.

19. The antenna according to claim 1, further comprising an amplifier amplifying said prescribed electric wave received.

20. The antenna according to claim 1, wherein said prescribed electric wave is an electric wave of an ultrahigh frequency band.

* * * * *